US009442422B1

(12) United States Patent
Terakado et al.

(10) Patent No.: US 9,442,422 B1
(45) Date of Patent: Sep. 13, 2016

(54) POWDER STORAGE CONTAINER, DEVELOPER REPLENISHMENT DEVICE, AND IMAGE FORMING APPARATUS

(71) Applicant: FUJI XEROX CO., LTD., Tokyo (JP)

(72) Inventors: Yuki Terakado, Kanagawa (JP); Yosuke Ninomiya, Kanagawa (JP); Takuji Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/842,054

(22) Filed: Sep. 1, 2015

(30) Foreign Application Priority Data

Mar. 27, 2015 (JP) ..... 2015-067404

(51) Int. Cl.
*G03G 15/08* (2006.01)

(52) U.S. Cl.
CPC ..... *G03G 15/0865* (2013.01)

(58) Field of Classification Search
CPC ..... G03G 15/0865; G03G 15/0886; G03G 2215/0692
See application file for complete search history.

(56) References Cited

U.S. PATENT DOCUMENTS

| | | | | |
|---|---|---|---|---|
| 5,970,291 | A * | 10/1999 | Miller | G03G 15/0855 141/346 |
| 8,918,029 | B2 | 12/2014 | Matsumoto | |
| 2007/0206975 | A1* | 9/2007 | Koyama | G03G 15/0886 399/262 |
| 2010/0166460 | A1* | 7/2010 | Maeshima | G03G 15/0868 399/119 |
| 2013/0078004 | A1* | 3/2013 | Matsumoto | G03G 15/0886 399/260 |
| 2014/0153974 | A1* | 6/2014 | Jimba | G03G 15/0879 399/262 |

FOREIGN PATENT DOCUMENTS

| | | |
|---|---|---|
| JP | 2011-076064 A | 4/2011 |
| JP | 2013-068823 A | 4/2013 |
| JP | 2013-174733 A | 9/2013 |

* cited by examiner

*Primary Examiner* — Sandra Brase
(74) *Attorney, Agent, or Firm* — Oliff PLC

(57) ABSTRACT

A powder storage container includes a storage container body, a movable member, and a restricting portion. The storage container body stores powder therein, and includes a supply portion that supplies the powder. The movable member is provided to the storage container body, and is movable between a closed position at which the supply portion is closed and a supply position at which the supply portion is able to supply the powder. The restricting portion is provided on an inner side with respect to an outer peripheral shape of the movable member to restrict movement of the movable member to the supply position.

7 Claims, 18 Drawing Sheets

POWDER STORAGE CONTAINER, DEVELOPER REPLENISHMENT DEVICE, AND IMAGE FORMING APPARATUS

CROSS-REFERENCE TO RELATED APPLICATIONS

This application is based on and claims priority under 35 USC 119 from Japanese Patent Application No. 2015-067404 filed Mar. 27, 2015.

BACKGROUND

Technical Field

The present invention relates to a powder storage container, a developer replenishment device, and an image forming apparatus.

SUMMARY

According to an aspect of the present invention, there is provided a powder storage container including: a storage container body that stores powder therein and that includes a supply portion that supplies the powder; a movable member that is provided to the storage container body and that is movable between a closed position at which the supply portion is closed and a supply position at which the supply portion is able to supply the powder; and a restricting portion provided on an inner side with respect to an outer peripheral shape of the movable member to restrict movement of the movable member to the supply position.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

First Exemplary Embodiment

Figure 1:
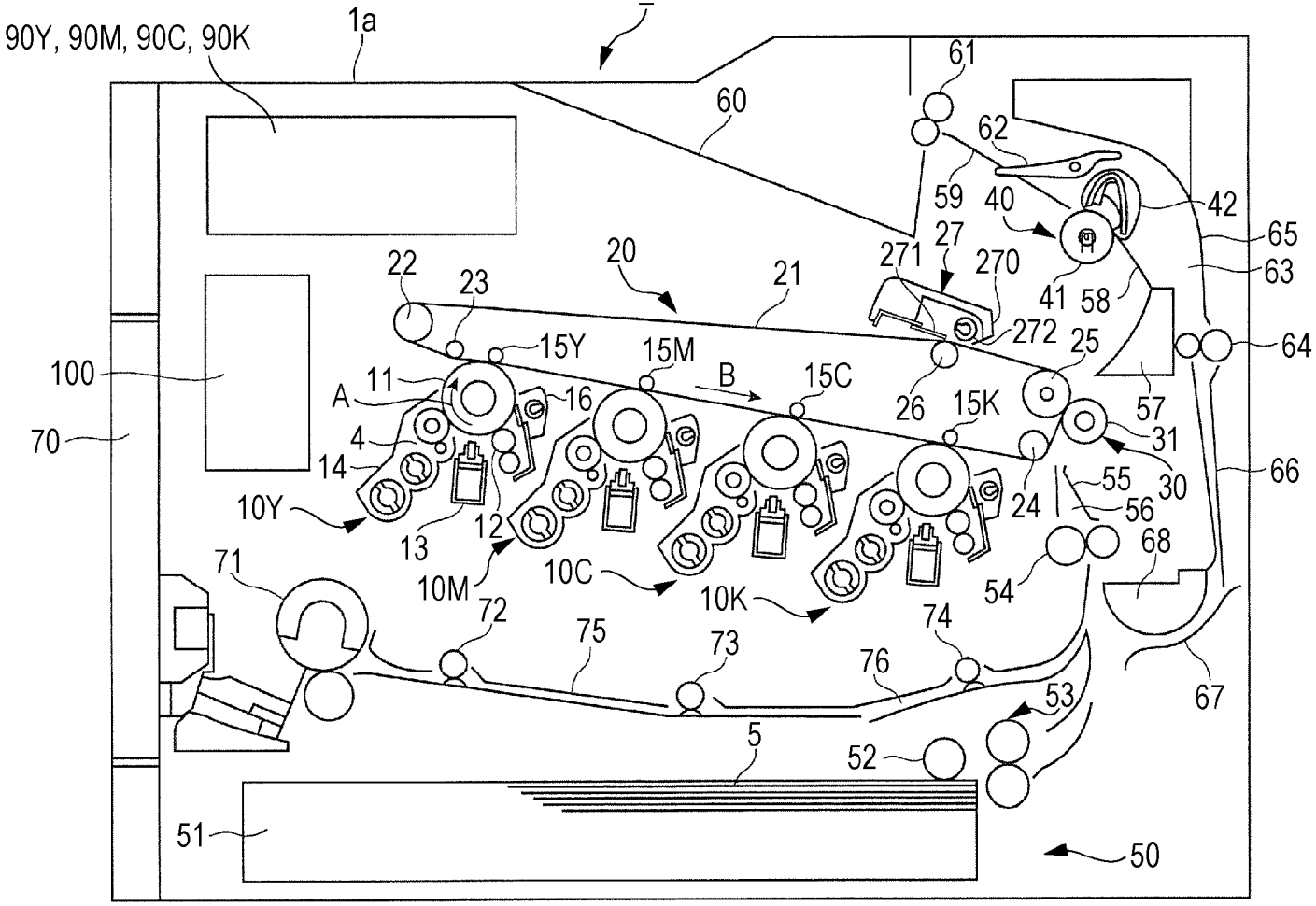
FIG. 1 illustrates the overall configuration of an image forming apparatus including a developer storage container and a developer replenishment device according to a first exemplary embodiment of the present invention.
Figure 2:
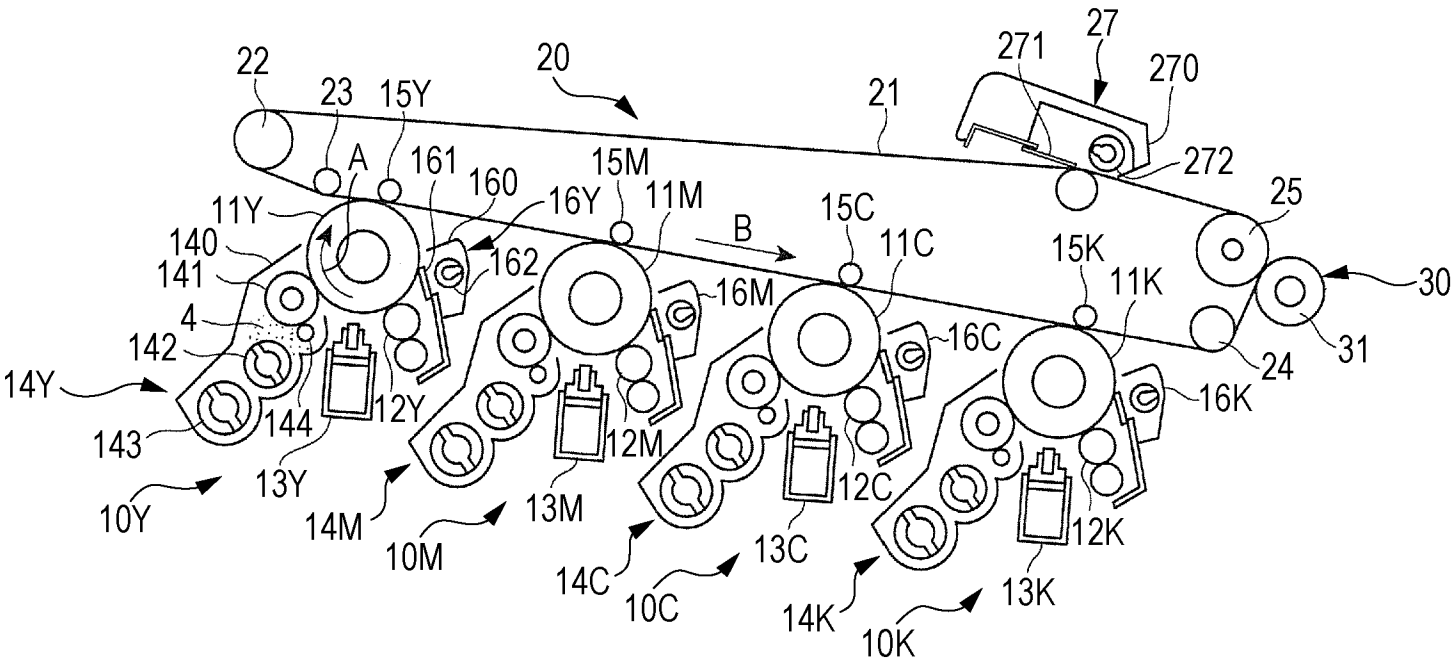
FIG. 2 illustrates the configuration of an image forming portion of the image forming apparatus according to the first exemplary embodiment of the present invention.

FIG. 1 illustrates an overview of the entire image forming apparatus including a developer storage container (powder storage container) and a developer replenishment device according to a first exemplary embodiment of the present invention. FIG. 2 illustrates a particular portion (such as an image preparing device) of the image forming apparatus as enlarged.

<Overall Configuration of Image Forming Apparatus>

An image forming apparatus 1 according to the first exemplary embodiment is configured as a color printer, for example. The image forming apparatus 1 includes plural image preparing devices 10, an intermediate transfer device 20, a paper feed device 50, a fixing device 40, and so forth. The image preparing devices 10 form a toner image to be developed using a toner that serves as a developer 4. The intermediate transfer device 20 holds the toner images formed by the image preparing devices 10 to transport the toner images finally to a second transfer position at which the toner images are subjected to a second transfer performed onto recording paper 5 that serves as an example of a recording medium. The paper feed device 50 stores and transports the prescribed recording paper 5 to be supplied to the second transfer position of the intermediate transfer device 20. The fixing device 40 fixes the toner images on the recording paper 5 which have been subjected to the second transfer performed by the intermediate transfer device 20. In the drawing, reference symbol 1*a* denotes a body of the image forming apparatus 1. The body 1*a* is formed from a support structure member, an outer covering, and so forth.

The image preparing devices 10 are composed of four image preparing devices 10Y, 10M, 10C, and 10K that exclusively form toner images in four colors, namely yellow (Y), magenta (M), cyan (C), and black (K), respectively. The four image preparing devices 10 (Y, M, C, K) are disposed side by side in line as inclined in the internal space of the body 1*a*.

As illustrated in FIGS. 1 and 2, the image preparing devices 10 (Y, M, C, K) each include a rotatable photosensitive drum 11 that serves as an example of an image holding element. The following devices that serve as an example of a toner image forming unit are principally disposed around the photosensitive drum 11. The devices include a charging device 12, an exposure device 13, a developing device 14 (Y, M, C, K), a first transfer device 15 (Y, M, C, K), a drum cleaning device 16 (Y, M, C, K), and so forth. The charging device 12 charges a peripheral surface (image holding surface) of the photosensitive drum 11, on which an image may be formed, with a prescribed potential. The exposure device 13 radiates light based on information (signal) on an image to the charged peripheral surface of the photosensitive drum 11 to form an electrostatic latent image (in each color) with a potential difference. The developing device 14 (Y, M, C, K) serves as an example of a developing unit that develops the electrostatic latent image using a toner of the developer 4 for the corresponding color (Y, M, C, K) to form a toner image. The first transfer device 15 (Y, M, C, K) serves as an example of a first transfer unit that transfers the toner image to the intermediate transfer device 20. The drum cleaning device 16 (Y, M, C, K) removes attached matter such as a toner remaining on and adhering to the image holding surface of the photosensitive drum 11 after being subjected to the first transfer to clean the photosensitive drum 11.

The photosensitive drum 11 has an image holding surface formed by providing a photoconductive layer (photosensitive layer) made of a photosensitive material on the peripheral surface of a grounded cylindrical or columnar base material. The photosensitive drum 11 is supported so as to receive power from a rotary drive device (not illustrated) to rotate in the direction indicated by the arrow A.

The charging device 12 is configured as a contact charging roller disposed in contact with the photosensitive drum 11. A charging voltage is supplied to the charging device 12. In the case where the developing device 14 performs reversal development, a voltage or a current having the same polarity as the polarity for charging the toner supplied from the developing device 14 is supplied as the charging voltage. A non-contact charging device such as a scorotron disposed without contact with the surface of the photosensitive drum 11 may be used as the charging device 12.

The exposure device 13 radiates the light, formed in accordance with the information on the image input to the image forming apparatus 1, toward the peripheral surface of the photosensitive drum 11 after being charged to form an electrostatic latent image. When a latent image is to be formed, information (signal) on the image input in any manner to the image forming apparatus 1 is transmitted to the exposure device 13.

The exposure device 13 is constituted of a light emitting diode (LED) print head that radiates light matching the image information to the photoconductor drum 11 using plural LEDs that serve as light emitting elements arranged along the axial direction of the photoconductor drum 11 to form an electrostatic latent image. In the exposure device 13, deflection scanning may be performed along the axial direction of the photoconductor drum 11 using laser light configured in accordance with the image information.

Figure 3:
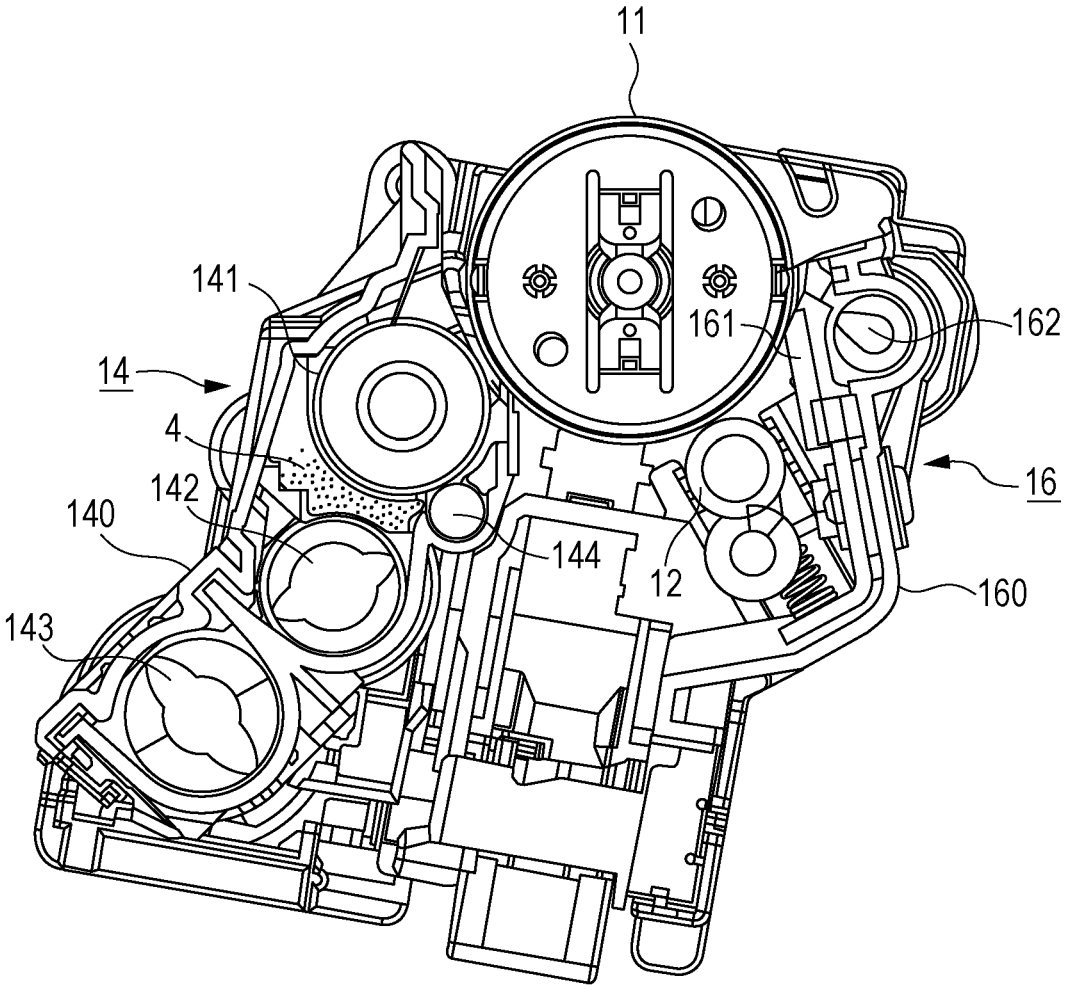
FIG. 3 is a sectional view illustrating the configuration of a process cartridge.

As illustrated in FIGS. 2 and 3, the developing devices 14 (Y, M, C, K) each include a housing 140, a developing roller 141, agitation/transport members 142 and 143, a layer thickness restricting member 144, and so forth. The housing 140 includes an opening portion and a storing chamber for the developer 4, and houses the other components. The developing roller 141 holds the developer 4, and transports the developer 4 to a development region facing the photosensitive drum 11. The agitation/transport members 142 and 143, which may be two screw augers, transport the developer 4 to cause the developer 4 to pass through the developing roller 141 while agitating the developer 4. The layer thickness restricting member 144 restricts the amount (layer thickness) of the developer held by the developing roller 141. A development voltage supplied from a power source device (not illustrated) is applied between the developing roller 141 of the developing device 14 and the photosensitive drum 11. In addition, power from a rotary drive device (not illustrated) is transmitted to the developing roller 141 and the agitation/transport members 142 and 143 to rotate the developing roller 141 and the agitation/transport members 142 and 143 in a prescribed direction. Further, a two-part developer containing a non-magnetic toner and a magnetic carrier is used as the developers 4 (Y, M, C, K) for the four colors. A one-component developer containing only a toner may be used as the developers 4 (Y, M, C, K) for the four colors.

The first transfer device 15 (Y, M, C, K) is a contact transfer device including a first transfer roller that rotates in contact with the periphery of the photosensitive drum 11 via an intermediate transfer belt 21 and that is supplied with a first transfer voltage. A DC voltage having a polarity opposite to the polarity for charging the toner is supplied from a power source device (not illustrated) as the first transfer voltage.

As illustrated in FIGS. 2 and 3, the drum cleaning device 16 includes a body 160, a cleaning plate 161, a feeding member 162, and so forth. The body 160 has the shape of a partially open container. The cleaning plate 161 is disposed so as to contact the peripheral surface of the photosensitive drum 11, after being subjected to the first transfer, with a prescribed pressure to clean the photosensitive drum 11 by removing attached matter such as a residual toner. The feeding member 162, which may be a screw auger, recovers attached matter, such as a toner, removed by the cleaning plate 161 to feed the attached matter to a recovery system (not illustrated). A plate-like member (e.g., a blade) made of a material such as rubber is used as the cleaning plate 161.

Figure 4:
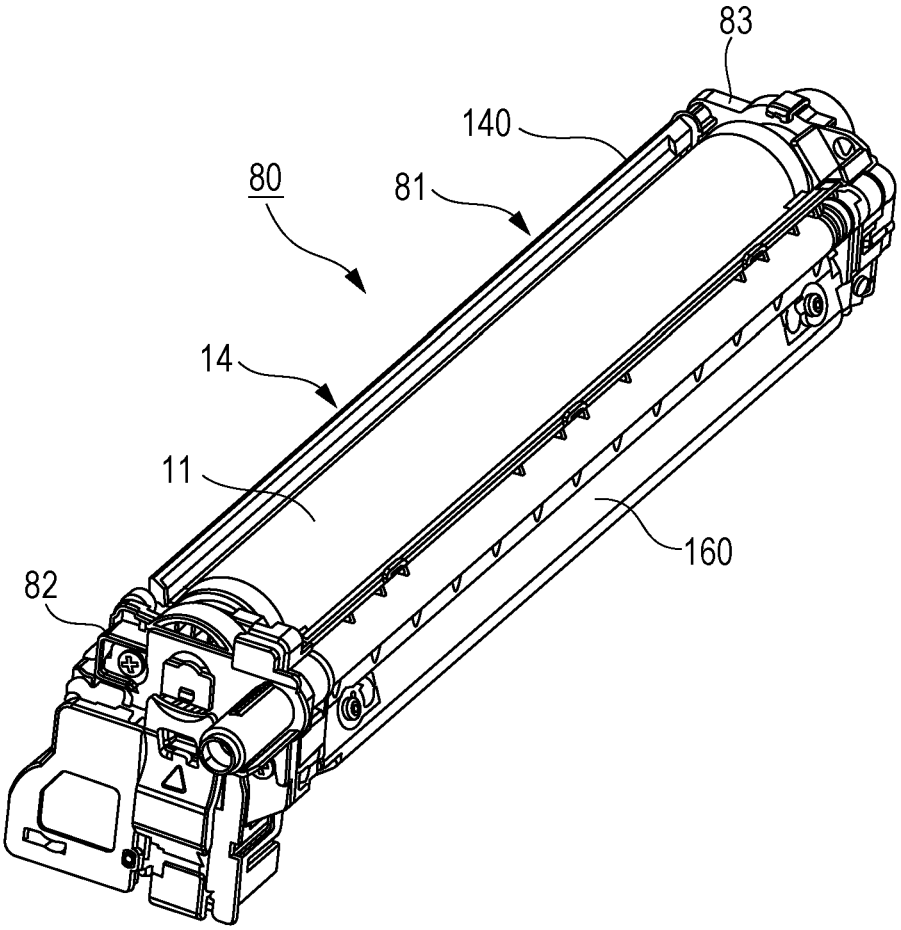
FIG. 4 is a perspective view illustrating the configuration of the process cartridge.

In the exemplary embodiment, as illustrated in FIG. 4, image forming members such as the photoconductor drum 11 and the charging device 12, the developing device 14, and the drum cleaning device 16 disposed around the photoconductor drum 11 are integrally unitized and assembled to each other to compose a process cartridge 80 that serves as an example of an image forming unit. The process cartridge 80 is composed of a process cartridge body 81, frame members 82 and 83 disposed at both end portions along the axial direction of the photosensitive drum 11, and so forth. It should be noted, however, that it is not necessary that the process cartridge 80 should include all of the image forming members such as the photoconductor drum 11 and the charging device 12, the developing device 14, and the drum cleaning device 15 disposed around the photoconductor drum 11. The process cartridge 80 may be composed of the photoconductor drum 11, the charging device 12, and the developing device 14, or may be composed of the photoconductor drum 11, the developing device 14, and so forth, among the image forming members.

The process cartridge 80 is moved along a guiding member such as a guide rail (not illustrated) provided inside the image forming apparatus body 1*a* to be mounted to and removed from the image forming apparatus body 1*a*. The process cartridge 80 is mounted to the image forming apparatus body 1*a* to be supplied with a drive force and electric power from the image forming apparatus body 1*a* side.

As illustrated in FIG. 1, the intermediate transfer device 20 is disposed at a position above the image preparing devices 10 (Y, M, C, K). The intermediate transfer device 20 is principally composed of the intermediate transfer belt 21, plural belt support rollers 22 to 26, a second transfer device 30, and a belt cleaning device 27. The intermediate transfer belt 21 rotates in the direction indicated by the arrow B while passing through first transfer positions between the photosensitive drums 11 and the first transfer devices 15

(first transfer rollers). The belt support rollers 22 to 26 rotatably support the intermediate transfer belt 21 by holding the intermediate transfer belt 21 in a desired state from the inner side. The second transfer device 30 serves as an example of a second transfer member disposed on the side of the outer peripheral surface (image holding surface) of the intermediate transfer belt 21 supported by the belt support roller 25 to transfer the toner image on the intermediate transfer belt 21 to the recording paper 5 through a second transfer. The belt cleaning device 27 cleans the intermediate transfer belt 21 by removing attached matter such as a toner and paper powder remaining on and adhering to the outer peripheral surface of the intermediate transfer belt 21 after passing through the second transfer device 30.

An endless belt fabricated from a material obtained by dispersing a resistance adjusting agent such as carbon black etc. in a synthetic resin such as a polyimide resin or a polyamide resin, for example, is used as the intermediate transfer belt 21. The belt support roller 22 is configured as a driving roller rotationally driven by a drive device (not illustrated). The belt support roller 23 is configured as a driven roller that maintains the travel position etc. of the intermediate transfer belt 21. The belt support roller 24 is configured as a tension applying roller that applies tension to the intermediate transfer belt 21. The belt support roller 25 is configured as a second transfer back-up roller. The belt support roller 26 is configured as a support roller that supports the back surface of the intermediate transfer belt 21 cleaned by the belt cleaning device 27.

As illustrated in FIG. 1, the second transfer device 30 is a contact transfer device including a second transfer roller 31 provided at the second transfer position, which is a portion of the outer peripheral surface of the intermediate transfer belt 21 supported by the belt support roller 25 in the intermediate transfer device 20. The second transfer roller 31 rotates in contact with the peripheral surface of the intermediate transfer belt 21, and is supplied with a second transfer voltage. A DC voltage having a polarity opposite to or the same as the polarity for charging the toner is supplied as the second transfer voltage to the second transfer device 31 or the support roller 25 of the intermediate transfer device 20.

As illustrated in FIG. 2, the belt cleaning device 27 is configured similarly to the drum cleaning device 16, and includes a body 270, a cleaning plate 271, a feeding member 272, and so forth. The body 270 has the shape of a partially open container. The cleaning plate 271 is disposed so as to contact the peripheral surface of the intermediate transfer belt 21, after being subjected to the second transfer, with a prescribed pressure to clean the intermediate transfer belt 21 by removing attached matter such as a residual toner. The feeding member 272, which may be a screw auger, recovers attached matter, such as a toner, removed by the cleaning plate 271 to feed the attached matter to a recovery system (not illustrated). A plate-like member (e.g. a blade) made of a material such as rubber is used as the cleaning plate 271.

The fixing device 40 is composed of a heating rotary member 41, a pressurizing rotary member 42, and so forth. The heating rotary member 41, which may be in the form of a drum or a belt, is heated by a heating unit such that the surface temperature is maintained at a prescribed temperature. The pressurizing rotary member 42, which may be in the form of a drum or a belt, rotates in contact with the heating rotary member 41 at a predetermined pressure in the state of being substantially parallel to the axial direction of the heating rotary member 41. In the fixing device 40, a contact portion at which the heating rotary member 41 and the pressurizing rotary member 42 contact each other serves as a fixation processing part at which a prescribed fixation process (heating and pressurization) is performed.

The paper feed device 50 is disposed at a position below the image preparing devices 10 (Y, M, C, K) for yellow (Y), magenta (M), cyan (C), and black (K). The paper feed device 50 is principally composed of one or more paper storing members 51 and feeding devices 52 and 53. The paper storing members 51 store a stack of sheets of the recording paper 5 of desired size, type, etc. The feeding devices 52 and 53 feed the recording paper 5, one sheet at a time, from the paper storing members 51. The paper storing members 51 are attached so as to be drawn out toward the front surface (a side surface that the user faces during operation) of the body 1*a*, that is, toward the left side surface in the illustrated example, for example.

Examples of the recording paper 5 include regular paper and overhead projector (OHP) sheets for use for electrophotographic copiers and printers. In order to further improve the smoothness of the surface of an image after being fixed, the surface of the recording paper 5 is preferably as smooth as possible. For example, coated paper prepared by coating the surface of regular paper with a resin or the like, so-called cardboard with a relatively large basis weight such as art paper for printing, and so forth may also be used.

A paper feed/transport path 56 is provided between the paper feed device 50 and the second transfer device 30. The paper feed/transport path 56 is composed of one or more pairs of paper transport rollers 54, a transport guide 55, and so forth. The pair of paper transport rollers 54 transport the recording paper 5 fed from the paper feed device 50 to the second transfer position. The pair of paper transport rollers 54 are configured as rollers (resist rollers) that adjust the timing to transport the recording paper 5, for example. Transport guides 57 and 58 etc. are provided between the second transfer device 30 and the fixing device 40. The transport guides 57 and 58 transport the recording paper 5 after being subjected to the second transfer fed from the second transfer roller 31 of the second transfer device 30 to the fixing device 40. Further, a pair of paper ejection rollers 61 are disposed near a paper ejection port formed in the body 1*a*. The pair of paper ejection rollers 61 eject the recording paper 5 after being fixed fed from the fixing device 40 to a paper ejection portion 60 provided at the upper portion of the body 1*a* along a transport guide 59.

A switching gate 62 that switches the paper transport path is provided between the fixing device 40 and the pair of paper ejection rollers 61. The rotational direction of the pair of paper ejection rollers 61 is switchable between the forward direction (ejection direction) and the reverse direction. In the case where an image is to be formed on both surfaces of the recording paper 5, the rotational direction of the pair of paper ejection rollers 61 is switched from the forward direction (ejection direction) to the reverse direction after the rear end of the recording paper 5, on one surface of which an image has been formed, passes through the switching gate 62. The transport path for the recording paper 5 which is transported in the reverse direction by the pair of paper ejection rollers 61 is switched by the switching gate 62 such that the recording paper 5 is transported to a two-sided printing transport path 63 formed along substantially the vertical direction. The two-sided printing transport path 63 includes a pair of paper transport rollers 64, transport guides 65 to 68, and so forth. The pair of paper transport rollers 64 transport the recording paper 5 to the pair of paper transport rollers 54 with the front and back sides of the recording paper 5 reversed.

In FIG. 1, reference numeral 70 denotes a manual feed tray provided on the front surface (in the drawing, left side surface) of the body 1*a* of the image forming apparatus 1 so as to be openable and closable. A feeding device 71 and a manual paper feed/transport path 76 are provided between the manual feed tray 70 and the pair of paper transport rollers 54. The feeding device 71 feeds the recording paper 5 housed in the manual feed tray 70, one sheet at a time. The manual paper feed/transport path 76 is composed of plural pairs of paper transport rollers 72 to 74, a transport guide 75, and so forth.

In FIG. 1, reference numeral 90 (Y, M, C, K) denotes each of plural toner cartridges that serve as an example of developer storing containers according to the exemplary embodiment that are arranged along a direction orthogonal to the sheet surface and that store a developer containing at least a toner to be supplied to the corresponding developing devices 14 (Y, M, C, K). The configuration of the toner cartridges will be discussed in detail later.

In FIG. 1, in addition, reference numeral 100 denotes a control device that comprehensively controls operation of the image forming apparatus 1. The control device 100 includes a central processing unit (CPU), a read only memory (ROM), a random access memory (RAM), a bus that connects between the CPU, the ROM, etc., a communication interface, and so forth (not illustrated).

<Operation of Image Forming Apparatus>

Basic image forming operation performed by the image forming apparatus 1 will be described below.

Operation for forming a full-color image by combining toner images in four colors (Y, M, C, K) using the four image preparing devices 10 (Y, M, C, K) will be described.

When the image forming apparatus 1 receives command information requesting image forming operation (printing), the four image preparing devices 10 (Y, M, C, K), the intermediate transfer device 20, the second transfer device 30, the fixing device 40, and so forth are started.

In each of the image preparing devices 10 (Y, M, C, K), first, the photosensitive drum 11 rotates in the direction indicated by the arrow A, and the charging device 12 charges the surface of the photosensitive drum 11 with a prescribed polarity (in the first exemplary embodiment, negative polarity) and a predefined potential. Then, the exposure device 13 radiates the surface of the photosensitive drum 11 after being charged with light emitted on the basis of a signal for an image obtained by converting information on an image input to the image forming apparatus 1 into each color component (Y, M, C, K). Thus, an electrostatic latent image for each color component with a prescribed potential difference is formed on the surface of the photosensitive drum 11.

Then, the developing device 14 (Y, M, C, K) develops the electrostatic latent image for each color component formed on the photosensitive drum 11 by supplying a toner for the corresponding color (Y, M, C, K) charged with a prescribed polarity (negative polarity) from the developing roller 141 for electrostatic adhesion. As a result of the development, the electrostatic latent images for the various color components formed on the photosensitive drums 11 are rendered manifest as toner images in the four colors (Y, M, C, K) developed using toners for the corresponding colors.

Then, when the toner image in each color formed on the photosensitive drum 11 of the image preparing device 10 (Y, M, C, K) is transported to the first transfer position, the first transfer device 15 performs a first transfer on the toner image in each color such that the toner images in the various colors are sequentially superposed on the intermediate transfer belt 21 of the intermediate transfer device 20 which rotates in the direction indicated by the arrow B.

In the image preparing devices 10 which have finished the first transfer, the drum cleaning device 16 removes, or scrapes off, attached matter to clean the surface of the photosensitive drum 11. This allows the image preparing devices 10 to be ready for the next image preparing operation.

Then, the intermediate transfer device 20 transports the toner images which have been subjected to the first transfer to the second transfer position through rotation of the intermediate transfer belt 21. Meanwhile, the paper feed device 50 feeds the prescribed recording paper 5 to the paper feed/transport path 56 in accordance with the image preparing operation. In the paper feed/transport path 56, the pair of paper transport rollers 54 that serve as resist rollers feed the recording paper 5 to the second transfer position in accordance with the transfer timing to supply the recording paper 5.

At the second transfer position, the second transfer roller 31 of the second transfer device 30 collectively performs a second transfer of the toner images on the intermediate transfer belt 21 onto the recording paper 5. In the intermediate transfer device 20 which has finished the second transfer, the belt cleaning device 27 cleans the intermediate transfer belt 21 by removing attached matter such as a toner remaining on the surface of the intermediate transfer belt 21 after the second transfer.

Then, the recording paper 5, onto which the toner images have been transferred through the second transfer, is peeled from the intermediate transfer belt 21 and the second transfer roller 31, and thereafter transported to the fixing device 40 via the transport guides 57 and 58. In the fixing device 40, the recording paper 5 after being subjected to the second transfer is introduced to the contact portion between the heating rotary member 41 and the pressurizing rotary member 42 which are rotating to pass through the contact portion to perform a necessary fixation process (heating and pressurization) to fix unfixed toner images to the recording paper 5. Lastly, in the case of image forming operation in which an image is to be formed on only one surface of the recording paper 5, the recording paper 5 after being subjected to the fixation is ejected to the paper ejection portion 60 provided at the upper portion of the body 1*a*, for example, by the pair of paper ejection rollers 61.

In the case where an image is to be formed on both surfaces of the recording paper 5, meanwhile, the recording paper 5, on one surface of which an image has been formed, is not ejected to the paper ejection portion 60 by the pair of paper ejection rollers 61, and the rotational direction of the pair of paper ejection rollers 61 is switched to the reverse direction while the pair of paper ejection rollers 61 hold the rear end of the recording paper 5. The recording paper 5 transported in the reverse direction by the pair of paper ejection rollers 61 passes over the switching gate 62, and thereafter is transported to the pair of paper transport rollers 54, with the front and back sides of the recording paper 5 reversed, via the two-sided printing transport path 63 which includes the pair of paper transport rollers 64, the transport guides 65 to 68, and so forth. The pair of paper transport rollers 54 feed the recording paper 5 to the second transfer position in accordance with the transfer timing so that an image is formed on the back surface of the recording paper 5. The recording paper 5 is ejected to the paper ejection portion 60 provided at the upper portion of the body 1*a* by the pair of paper ejection rollers 61.

As a result of the operation described above, the recording paper 5 is output with a full-color image formed thereon by combining the toner images in the four colors.

<Configuration of Developer Storage Container>

In the image forming apparatus 1 according to the first exemplary embodiment, as illustrated in FIGS. 1 and 2, the toner composing the developer 4 stored inside the developing device 14 of the image preparing device 10 (Y, M, C, K) is consumed along with the image forming operation performed in the image preparing device 10 (Y, M, C, K) for yellow (Y), magenta (M), cyan (C), and black (K) to form a toner image in the corresponding color.

Figure 5:
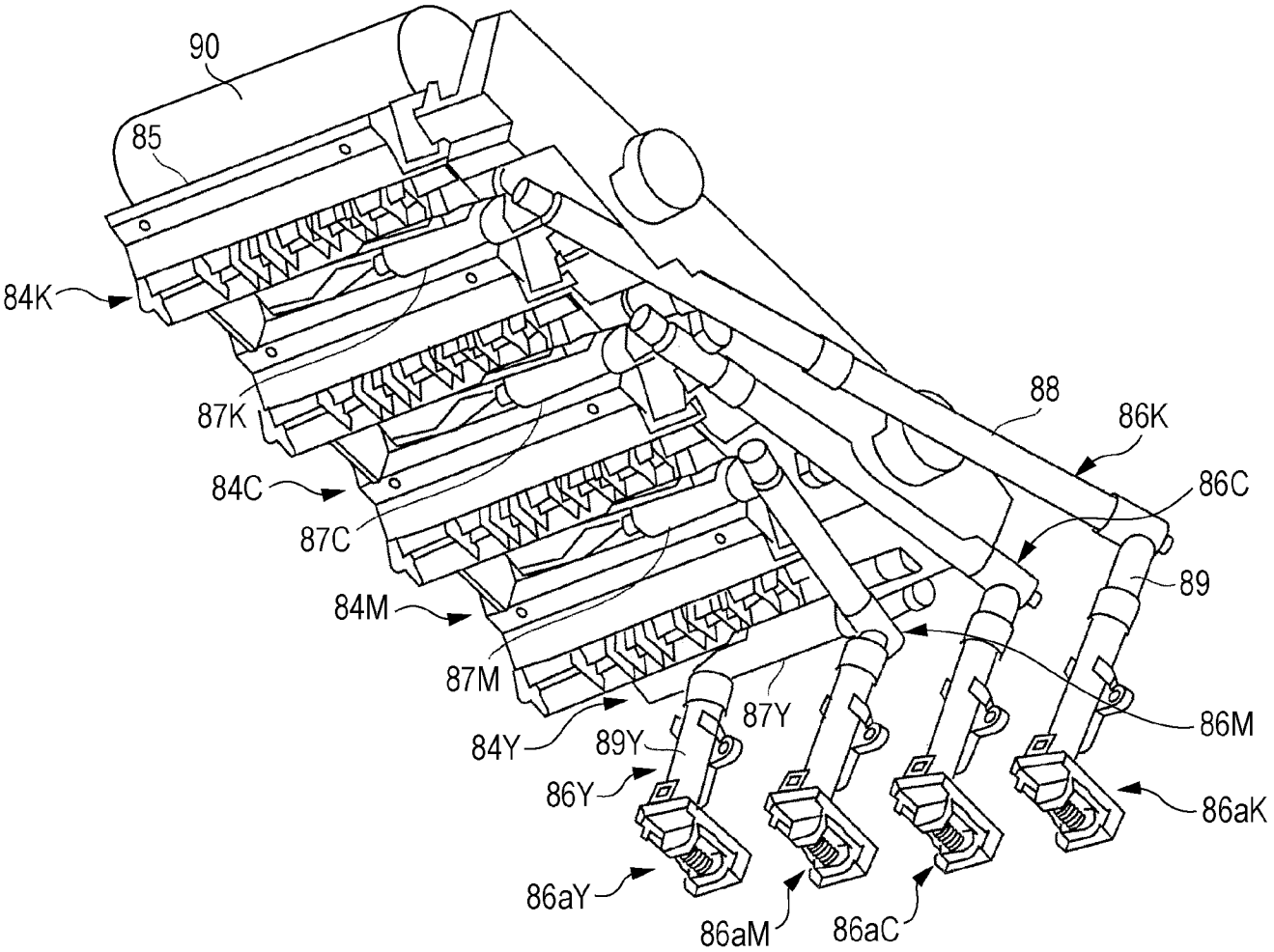
FIG. 5 is a perspective view illustrating the configuration of a toner replenishment device.

As illustrated in FIG. 5, the image forming apparatus 1 includes the toner cartridge 90 which serves as an example of a developer storage container that stores a developer containing at least a toner to be supplied to the developing device 14 of the image preparing device 10 (Y, M, C, K) for yellow (Y), magenta (M), cyan (C), and black (K). In the exemplary embodiment, only the toner is stored as the developer inside the toner cartridge 90. The toner stored in the toner cartridge 90 is supplied to the corresponding developing device 14 by a toner replenishment device 84 that serves as an example of a developer replenishment device.

The toner replenishment device 84 includes a cartridge mount portion 85, a toner transport member 86, and a joint member 86*a*. The toner cartridge 90 is mounted to the cartridge mount portion 85. The toner transport member 86 transports the toner from the toner cartridge 90 mounted to the cartridge mount portion 85 to the developing device 14. The joint member 86*a* is provided at an end portion of the toner transport member 86 on the developing device 14 side so as to be movable in the transport direction of the toner and the direction that crosses the transport direction of the toner to be joined to the developing device 14 so as to be able to replenish the developing device 14 with the toner. The toner transport member 86 is composed of a first toner transport portion 87, a second toner transport portion 88, and a third toner transport portion 89. The first toner transport portion 87 is disposed on the lower surface of the cartridge mount portion 85. The second toner transport portion 88 is connected to an end portion of the first toner transport portion 87. The third toner transport portion 89 is connected to an end portion of the second toner transport portion 88.

Figure 6:
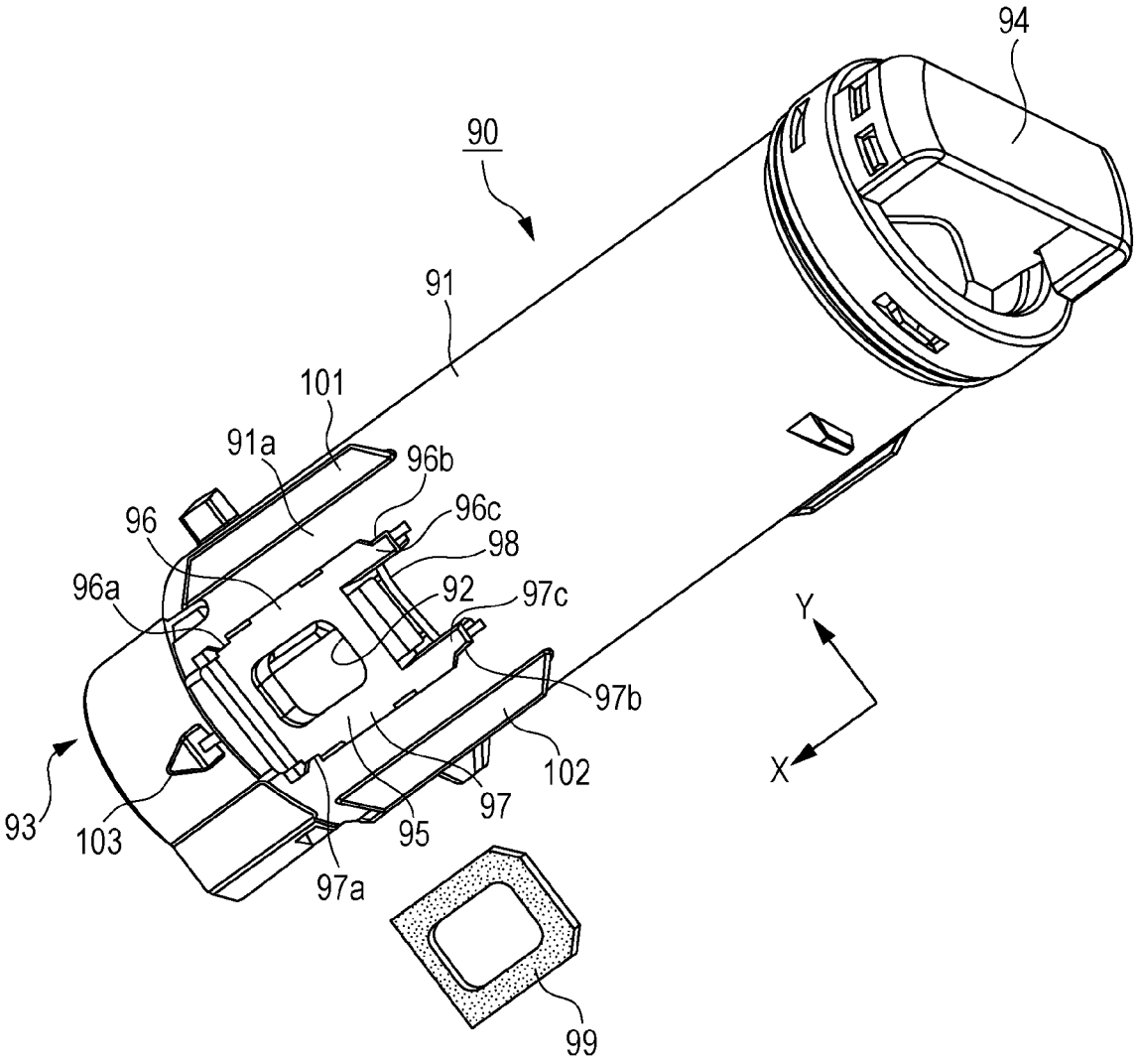
FIG. 6 is a perspective view illustrating the configuration of a toner cartridge.
Figure 7:
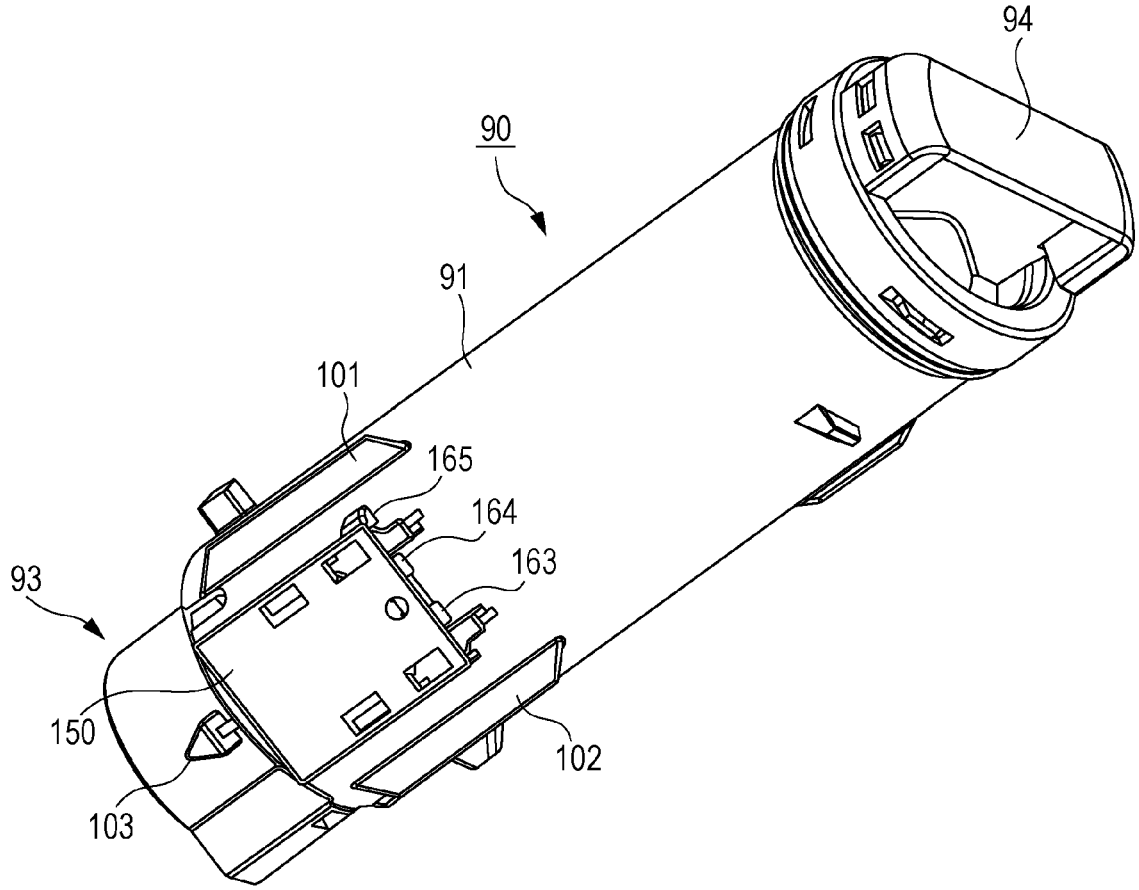
FIG. 7 is a perspective view illustrating the configuration of the toner cartridge.

As illustrated in FIGS. 6 and 7, the toner cartridge 90 includes a toner cartridge body 91, a toner supply port 92, and a shutter member 150. The toner cartridge body 91 serves as an example of a storage container body formed in a substantially cylindrical shape having a toner storage chamber that stores a toner that is powder therein. The toner supply port 92 serves as an example of a supply portion (opening portion) that supplies the toner stored inside the toner cartridge body 91. The shutter member 150 serves as an example of a movable member that is movable to open and close the toner supply port 92.

A drive force transmission portion 93 is provided at the distal end portion of the toner cartridge body 91 along the mount direction (X direction in the drawing) of the toner cartridge 90. The drive force transmission portion 93 transmits a rotational driving force from the image forming apparatus body 1*a* side to an agitation/transport member (not illustrated) rotatably provided inside the toner cartridge body 91. In addition, a grip portion 94 is provided at the base end portion of the toner cartridge body 91 along the mount direction of the toner cartridge 90. The grip portion 94 is gripped by the user to mount the toner cartridge 90 to the image forming apparatus body 1*a*.

Figure 8A:
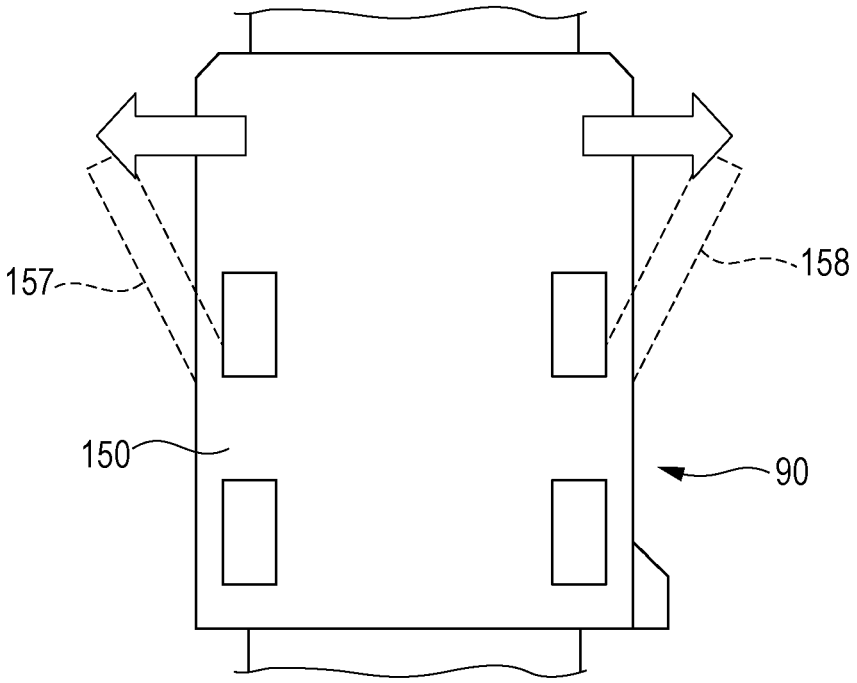
FIGS. 8A and 8B illustrate the configuration of a portion of the toner cartridge.
Figure 8B:
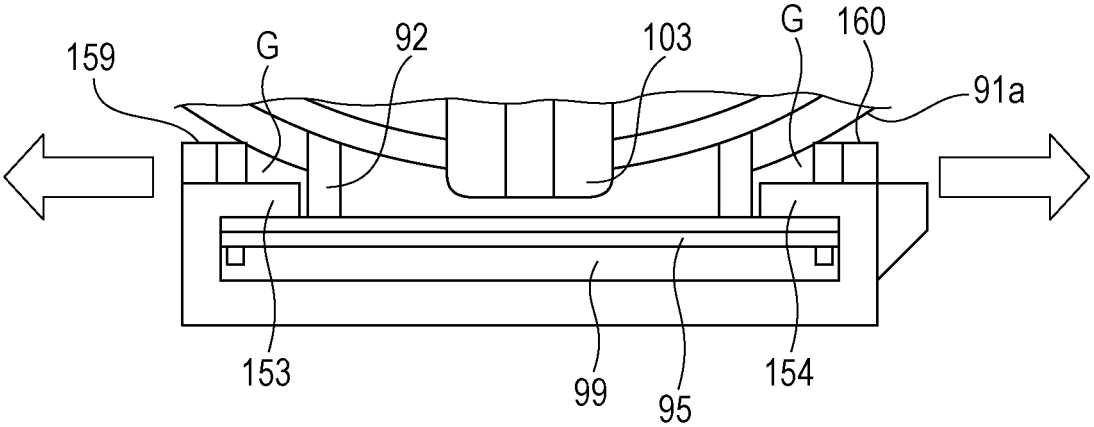

The toner supply port 92 is an opening portion in a substantially rectangular cylindrical shape provided in a bottom wall 91*a* on the distal end side along the mount direction of the toner cartridge 90. A flange portion 95 in a substantially rectangular shape as seen in plan is provided at the outer periphery of the lower end portion of the toner supply port 92. The flange portion 95 is formed to be flush with the opening surface of the toner supply port 92. As illustrated in FIGS. 8A and 8B, gaps G that allow insertion of holding portions 153 and 154 of the shutter member 150 to be discussed later are provided between the flange portion 95 and the bottom wall 91*a* of the toner cartridge body 91.

Figure 9:
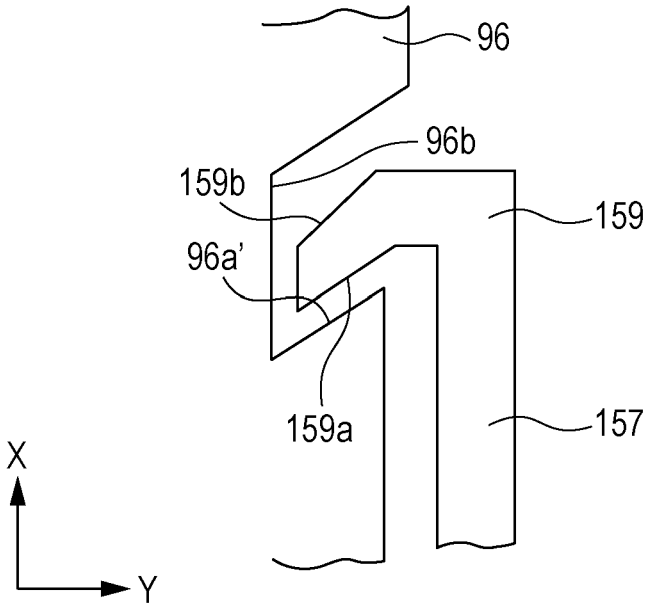
FIG. 9 illustrates a schematic configuration of a portion of the toner cartridge.

As illustrated in FIG. 6, mounting/removing portions 96 and 97 are provided at both end portions of the flange portion 95 along the direction (Y direction in the drawing) that crosses the mount direction of the toner cartridge 90. The mounting/removing portions 96 and 97 are formed in the shape of a thin and long flat plate for mounting and removal of the shutter member 150. Notched portions 96*a* and 97*a* in a recessed groove shape are provided at the distal end portions of the mounting/removing portions 96 and 97 along the mount direction of the toner cartridge 90. As illustrated in FIG. 9, a side surface 96*a*' of the notched portion 96*a* positioned on the base end portion side along the mount direction of the toner cartridge 90 is formed as an inclined surface inclined toward the base end portion along the mount direction of the toner cartridge 90 as the side surface 96*a*' extends toward the deep side.

In addition, introduction portions 96*c* and 97*c* are provided at end portions of the mounting/removing portions 96 and 97 on the front side along the mount direction of the toner cartridge 90. The introduction portions 96*c* and 97*c* are formed to be narrower than the mounting/removing portions 96 and 97 in the direction that crosses the mount direction of the toner cartridge 90 via guiding surfaces 96*b* and 97*b* inclined inward. Further, the bottom wall 91*a* of the toner cartridge body 91 is provided with a retention plate portion 98 that couples the left and right introduction portions 96*c* and 97*c*. The retention plate portion 98 contacts abutment portions 163 and 164 provided to the shutter member 150 when closing the shutter member 150 to stop the shutter member 150 at the closed position.

In addition, as illustrated in FIG. 6, the bottom surface of the flange portion 95 is provided with a sealing member 99 made of foamed polyurethane or the like by bonding or the like. The sealing member 99 prevents a gap, which permits leakage of the toner, from being formed between the shutter member 150 and the bottom surface of the flange portion 95.

Further, as illustrated in FIGS. 6 and 7, guide plates 101 and 102 are provided at the distal end portion of the bottom surface of the toner cartridge body 91 along the mount direction. The guide plates 101 and 102 guide the toner cartridge 90 when mounting the toner cartridge 90 to the mount portion 85. In addition, a projected portion 103 in a triangular column shape that projects downward is provided on the bottom surface of the drive force transmission portion 93 of the toner cartridge 90. The projected portion 103 moves a shutter member 118 on the cartridge mount portion 85 side to be discussed later along the opening/closing direction.

Figure 10:
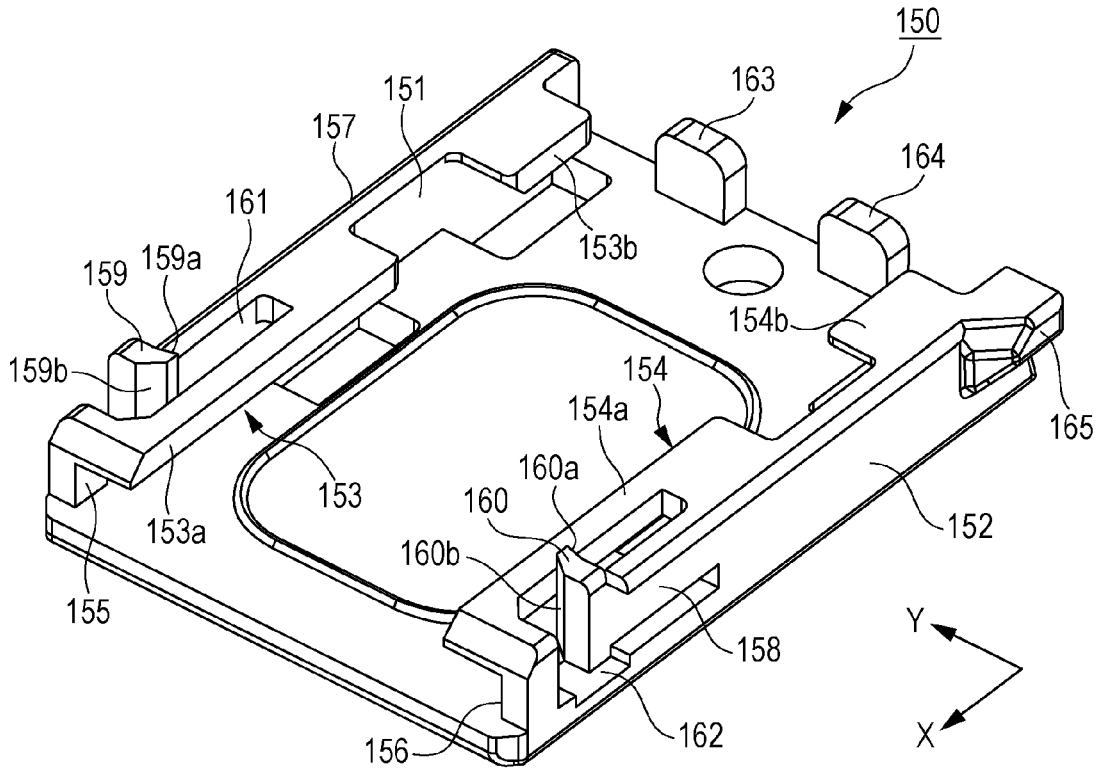
FIG. 10 is a perspective view illustrating a shutter member.
Figure 11:
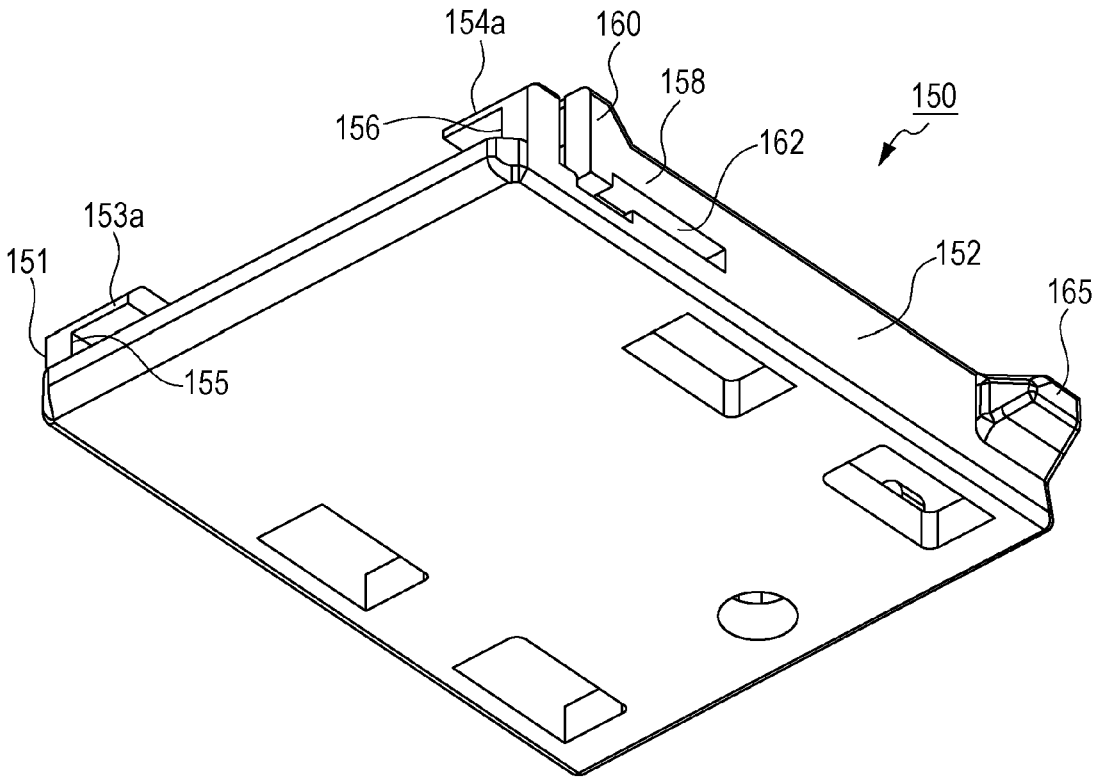
FIG. 11 is a perspective view illustrating the shutter member.

Meanwhile, as illustrated in FIGS. 10 and 11, the shutter member 150 is integrally formed in a substantially flat shape that is rectangular as seen in plan from a synthetic resin or the like through injection molding. Side walls 151 and 152 are provided on the upper surface of the shutter member 150. The side walls 151 and 152 are formed at both end portions along the direction (Y direction in the drawing) that crosses the opening/closing direction (X direction in the drawing) of the shutter member 150 to stand upward (toward the toner cartridge 90) to a low height. The holding portions 153 and 154 are provided at the upper end portions of the side walls 151 and 152. The holding portions 153 and 154 are formed in a narrow flat plate shape to extend inward in parallel with the upper surface of the shutter member 150 so as to oppose each other. The holding portions 153 and 154 are divided into first holding portions 153*a* and 154*a* and second holding portions 153*b* and 154*b*. The first holding portions 153*a* and 154*a* are relatively long, and are provided on the distal end side along the opening/closing direction of the shutter member 150. The second holding portions 153*b* and 154*b* are relatively short, and are provided on the base end side. Recessed grooves 155 and 156 are provided between the upper surface of the shutter member 150 and the lower surfaces of the holding portions 153 and 154. The shutter member 150 is slidably mounted to the mounting/removing portions 96 and 97 of the toner cartridge 90 via the recessed grooves 155 and 156.

Figure 12A:
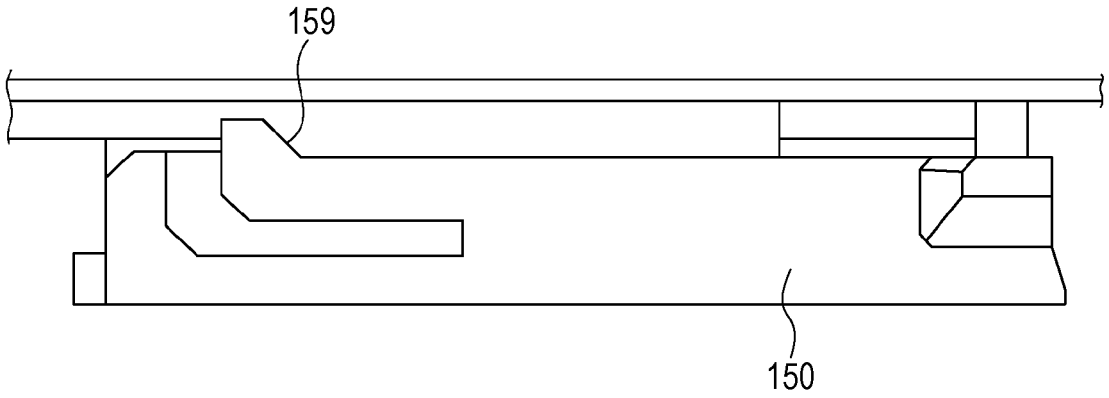
FIGS. 12A and 12B illustrate a portion of the shutter member.
Figure 12B:
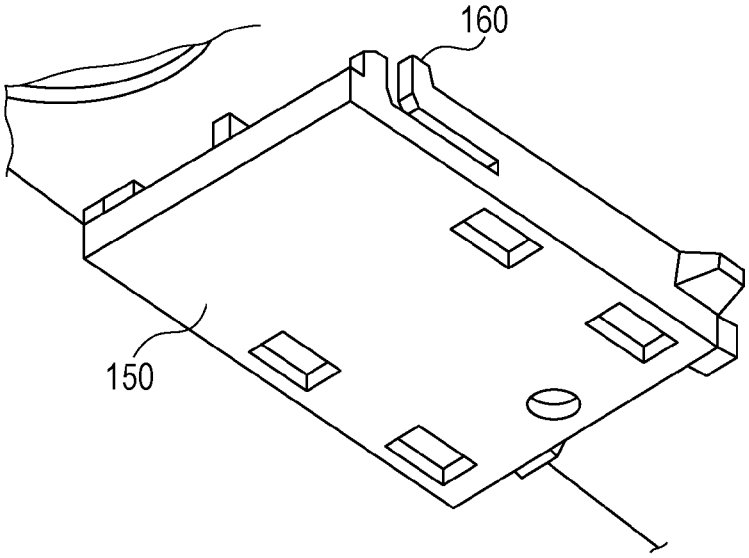

In addition, as illustrated in FIGS. 10 and 11, restricting portions 157 and 158 are provided at the distal end portions of the side walls 151 and 152 of the shutter member 150 along the opening/closing direction of the shutter member 150. The restricting portions 157 and 158 engage with (catch on) the notched portions 96*a* and 97*a* provided in the mounting/removing portions 96 and 97 of the toner cartridge 90 to restrict movement of the shutter member 150 from the closed position, at which the toner supply port 92 is closed, to the open position. The restricting portions 157 and 158 are formed to have the same side surface as the outer peripheral shape of the shutter member 150, or to be positioned on the inner side with respect to the outer peripheral shape of the shutter member 150. The phrase "on the inner side with respect to the outer peripheral shape of the shutter member 150" is intended to also include the same side surface as the outer peripheral shape of the shutter member 150. The restricting portions 157 and 158 are formed in a cantilever shape in which the base end portions of the restricting portions 157 and 158 are formed integrally with the side walls 151 and 152 and the distal end portions of the restricting portions 157 and 158 are elastically deformable in the direction that crosses the opening/closing direction of the shutter member 150. Engagement protrusions 159 and 160 are provided at the distal ends of the restricting portions 157 and 158. The engagement protrusions 159 and 160 project inward along the direction that crosses the opening/closing direction of the shutter member 150 and upward from the side walls 151 and 152 of the shutter member 150. As illustrated in FIG. 9, side surfaces 159*a* and 160*a* of the engagement protrusions 159 and 160 that are positioned on the base end side along the opening/closing direction of the shutter member 150 constitute an inclined surface inclined toward the base end portions along the opening/closing direction of the shutter member 150 in order to reliably engage with the notched portions 96*a* and 97*a* of the toner cartridge 90. In addition, the upper end portions of side surfaces 159*b* and 160*b* of the engagement protrusions 159 and 160 that are positioned on the distal end side along the opening/closing direction of the shutter member 150 constitute an inclined surface that serves as an example of a canceling portion that contacts canceling portions 131 and 132 on the cartridge mount portion 85 side to be discussed later to displace the engagement protrusions 159 and 160 outward along the direction that crosses the opening/closing direction of the shutter member 150. As illustrated in FIGS. 12A and 12B, the upper end portions of the engagement protrusions 159 and 160 of the restricting portions 157 and 158 are formed to project upward with respect to the upper end surface of the shutter member 150.

In addition, as illustrated in FIGS. 10 and 11, gaps 161 and 162 are formed in the side walls 151 and 152 and the holding portions 153 and 154 of the shutter member 150 to allow deformation of the restricting portions 157 and 158.

Further, the abutment portions 163 and 164 are provided on the upper surface of the shutter member 150 at the base end portion along the opening/closing direction of the shutter member 150. In addition, a stop portion 165 that projects laterally is provided on the side wall 152 of the shutter member 150 at the base end portion along the opening/closing direction of the shutter member 150.

<Configuration of Cartridge Mount Portion>

Figure 13:
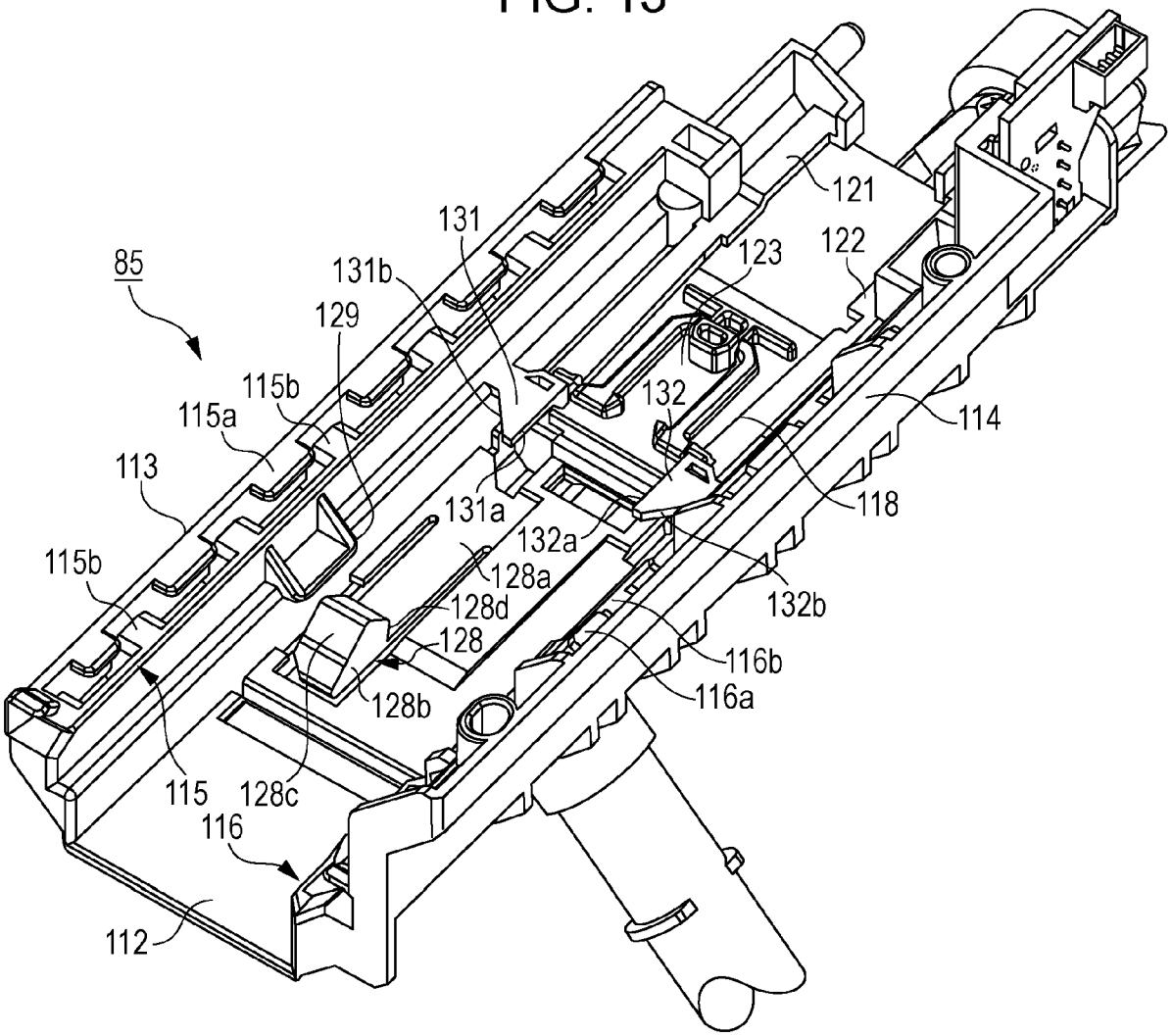
FIG. 13 is a perspective view illustrating the configuration of a cartridge mount portion.

As illustrated in FIG. 13, the cartridge mount portion 85 is formed from a bottom wall 112 and side walls 113 and 114. The bottom wall 112 has a substantially rectangular shape corresponding to the planar shape of the toner cartridge 90. The side walls 113 and 114 are provided at both ends of the bottom wall 112 along the width direction of the bottom wall 112. The cartridge mount portion 85 is formed as a frame body that has a U-shape as seen from the front, in which an upper side and an end portion on the front side along the mount direction have openings.

Guide portions 115 and 116 are provided on the side walls 113 and 114 of the cartridge mount portion 85 at the upper portion of the inner surfaces of the side walls 113 and 114. The guide portions 115 and 116 guide the guide plates 101 and 102 of the toner cartridge 90 along the mounting/removing direction. The guide portions 115 and 116 are composed of plural side surface guiding portions 115*a* and 116*a* and plural bottom surface guiding portions 115*b* and 116*b*. The side surface guiding portions 115*a* and 115*b* are provided at the upper portion of the side walls 113 and 114 to project inward. The bottom surface guiding portions 115*b* and 116*b* are provided at a position below the side surface guiding portions 115*a* and 116*a* to extend in parallel with the side surface guiding portions 115*a* and 116*a*.

Figure 14:
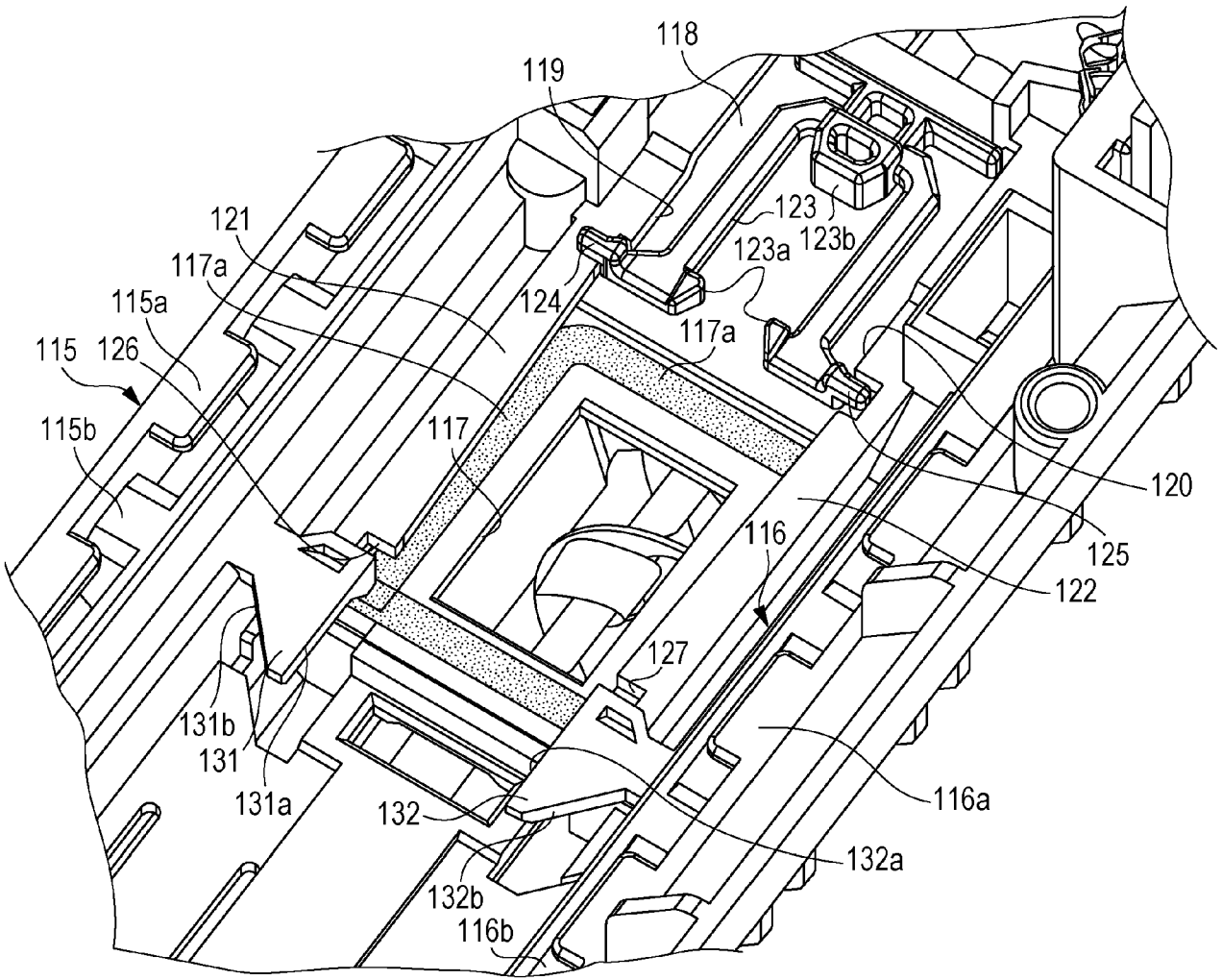
FIG. 14 is a perspective view illustrating the configuration of a portion of the cartridge mount portion.

As illustrated in FIG. 14, a toner receiving port 117 in a rectangular shape as seen in plan opens in the bottom wall 112 of the cartridge mount portion 85 on the distal end side along the mount direction of the toner cartridge 90. The toner receiving port 117 receives the toner supplied from the toner cartridge 90. In addition, the shutter member 118 is mounted to the bottom wall 112 of the cartridge mount portion 85 so as to be slidable in recessed grooves 119 and 120 provided in the side walls 113 and 114. The shutter member 118 is formed in a flat plate shape that is rectangular as seen in plan, and opens and closes the toner receiving port 117. The recessed grooves 119 and 120 are defined by narrow side plates 121 and 122 and the bottom wall 112. The side plates 121 and 122 are provided on the inner side surfaces of the side walls 113 and 114 to extend in parallel with the bottom wall 112. The outer periphery of the toner receiving port 117 is provided with a sealing member 117*a* made of foamed polyurethane or the like by bonding or the like. The sealing member 117*a* prevents a gap from being formed between the shutter member 118 and the outer periphery of the toner receiving port 117.

The shutter member 118 is opened and closed by the projected portion 103 (see FIG. 6) for engagement having a substantially triangular shape as seen in plan and provided on the bottom portion of the toner cartridge 90 engaging with a recessed portion 123 for engagement provided in the upper end surface of the shutter member 118. When mounting the toner cartridge 90 to the cartridge mount portion 85, the engagement projected portion 103 of the toner cartridge 90 is housed inside the engagement recessed portion 123 of the shutter member 150 with the projected portion 103 climbing over protrusions 123*a* provided at the entrance to the engagement recessed portion 123 to contact a side wall 123*b* of the engagement recessed portion 123 to push the shutter member 118, which opens the toner receiving port 117.

When the toner cartridge 90 is removed from the cartridge mount portion 85, meanwhile, the engagement projected portion 103 of the toner cartridge 90 contacts the protrusion 123*a* provided at the entrance to the engagement recessed portion 123 of the shutter member 150 from the inner side to push the shutter member 118 toward the front side via the protrusion 123*a*, which closes the toner receiving port 117. As illustrated in FIG. 13, when the shutter member 118 is pressed downward by the engagement projected portion 103 of the toner cartridge 90 with the toner receiving port 117 closed, engagement between the engagement projected portion 103 of the toner cartridge 90 and the shutter member 118 is released.

As illustrated in FIG. 14, the side plates 121 and 122 of the cartridge mount portion 85 are provided with recessed portions 126 and 127 that house arm portions 124 and 125 provided to project from both side surfaces of the shutter member 118. As illustrated in FIG. 13, when the shutter member 118 is pressed downward by the engagement projected portion 103 of the toner cartridge 90 with the toner receiving port 117 closed, the shutter member 118 is moved downward with the arm portions 124 and 125 of the shutter member 118 housed in the recessed portions 126 and 127, and engagement between the engagement projected portion 103 of the toner cartridge 90 and the engagement recessed portion 123 is released.

Further, an urging member 128 that is elastically deformable is integrally provided on the bottom wall 112 of the cartridge mount portion 85 on the front side with respect to the toner receiving port 117 along the mount direction of the toner cartridge 90. The urging member 128 urges the shutter member 150 of the toner cartridge 90 upward (toward the toner cartridge body). A base end portion 128*a* of the urging member 128 is formed integrally with the bottom wall 112 of the cartridge mount portion 85. In addition, an inclined surface 128*c* is provided at a distal end portion 128*b* of the urging member 128. The inclined surface 128*c* urges the shutter member 150 of the toner cartridge 90 upward. In addition, an engagement surface 128*d* is provided at the distal end portion 128*b* of the urging member 128 on the toner receiving port 117 side with respect to the engagement surface 128*c*. The engagement surface 128*d* extends substantially vertically, and engages with the shutter member 150 of the toner cartridge 90 to move the shutter member 150 in the closing direction when removing the toner cartridge 90. A contact portion 129 is provided on both the side walls 113 and 114, or at least one side wall 113, of the cartridge mount portion 85. The upper surface of the holding portions 153 and 154 of the shutter member 150 contacts the contact portion 129.

In addition, as illustrated in FIGS. 13 and 14, the canceling portions 131 and 132 are integrally provided on the side walls 113 and 114 of the cartridge mount portion 85 on the front side of the toner receiving port 117. The canceling portions 131 and 132 contact the engagement protrusions 159 and 160 of the restricting portions 157 and 158 of the shutter member 150 to elastically deform the restricting portions 157 and 158 of the shutter member 150 outward along the direction that crosses the opening/closing direction of the shutter member 150.

The canceling portions 131 and 132 are formed as a flat plate having a substantially triangular shape as seen in plan from inner side surfaces 131*a* and 132*a* and inclined surfaces 131*b* and 132*b*. The inner side surfaces 131*a* and 132*a* are formed to extend in parallel with the opening/closing direction of the shutter member 150. The inclined surfaces 131*b* and 132*b* are inclined outward in the direction that crosses the opening/closing direction of the shutter member. In addition, the canceling portions 131 and 132 are disposed at a position slightly above the upper end surface of the shutter member 150 of the toner cartridge 90 mounted to the cartridge mount portion 85. In addition, the lower surface of the contact portion 129 discussed above is set to a position below the upper surfaces of the canceling portions 131 and 132. As a result, as illustrated in FIG. 8B, the canceling portions 131 and 132 contact the upper portions of the side surfaces 159*b* and 160*b* which serve as an example of a canceling portion that projects upward with respect to the upper end surface of the shutter member 150.

Figure 15:
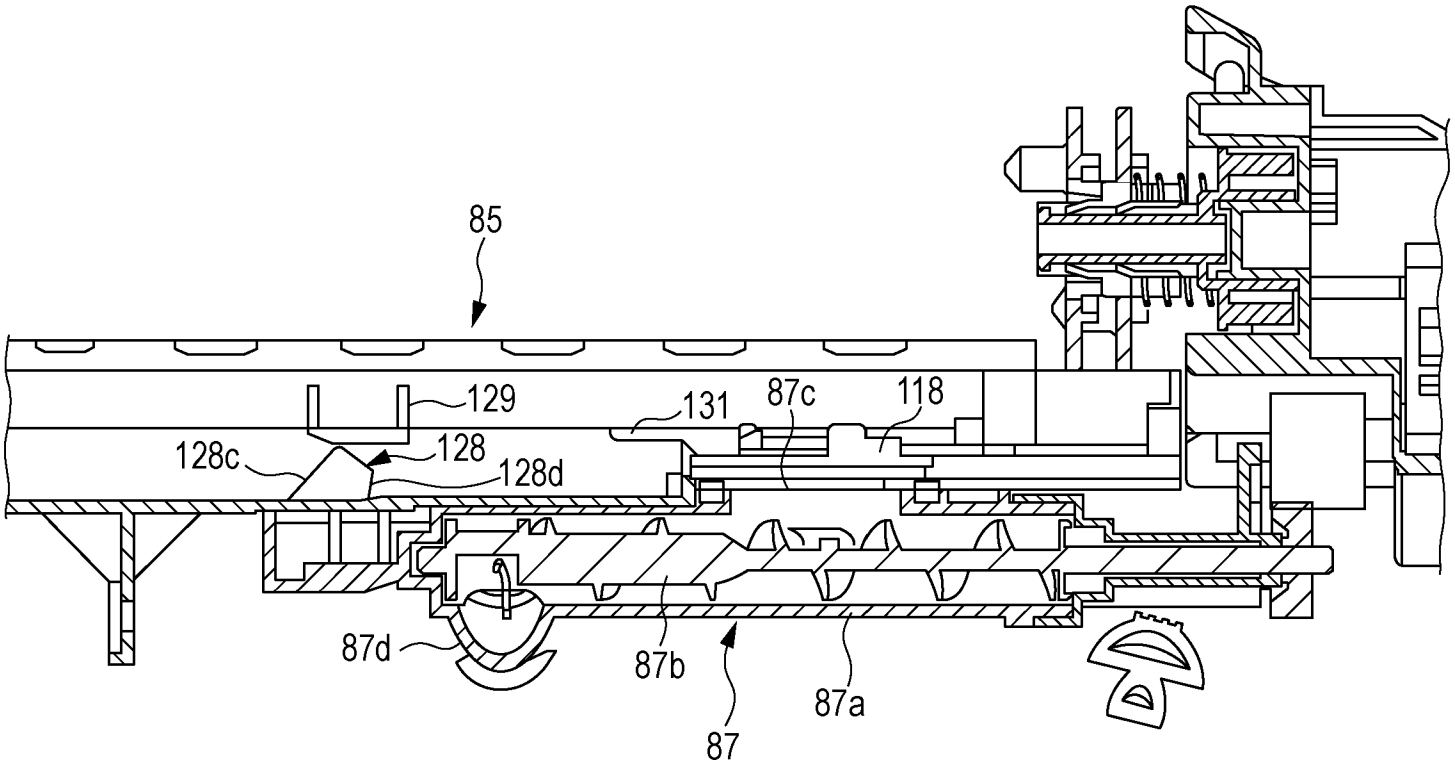
FIG. 15 is a sectional view illustrating the configuration of the cartridge mount portion.

In addition, as illustrated in FIG. 15, the first toner transport portion 87 of the toner replenishment device 84 is provided on the lower surface of the bottom wall 112 of the cartridge mount portion 85. The first toner transport portion 87 includes a first toner transport path forming member 87*a* and a first agitation/transport member 87*b*. The first toner transport path forming member 87*a* is formed in a cylindrical shape. The first agitation/transport member 87*b* is constituted of a screw auger or the like rotatably disposed inside the first toner transport path forming member 87*a*. The first toner transport path forming member 87*a* has a toner replenishment port 87*c* that opens at a position corresponding to the toner supply port 92 of the toner cartridge 90. The first toner transport path forming member 87*a* also has an opening portion 87*d* provided at the distal end portion along the transport direction of the first agitation/transport member 87*b* to allow the toner to fall down into the second toner transport portion 88.

<Operation of Mounting and Removing Toner Cartridge>

The toner cartridge 90 according to the exemplary embodiment is mounted to and removed from the cartridge mount portion 85 as follows.

When the toner cartridge 90 is not mounted to the cartridge mount portion 85, as illustrated in FIG. 7, the toner supply port 92 is closed by the shutter member 150. Movement of the shutter member 150 from the closed position, at which the toner supply port 92 is closed, to the open position is restricted with the side surfaces 159*a* and 160*a* of the engagement protrusions 159 and 160 of the restricting portions 157 and 158 in engagement with the notched portions 96*a* and 97*a* of the mounting/removing portions 96 and 97 of the toner cartridge 90 as illustrated in FIG. 9.

Figure 16A:
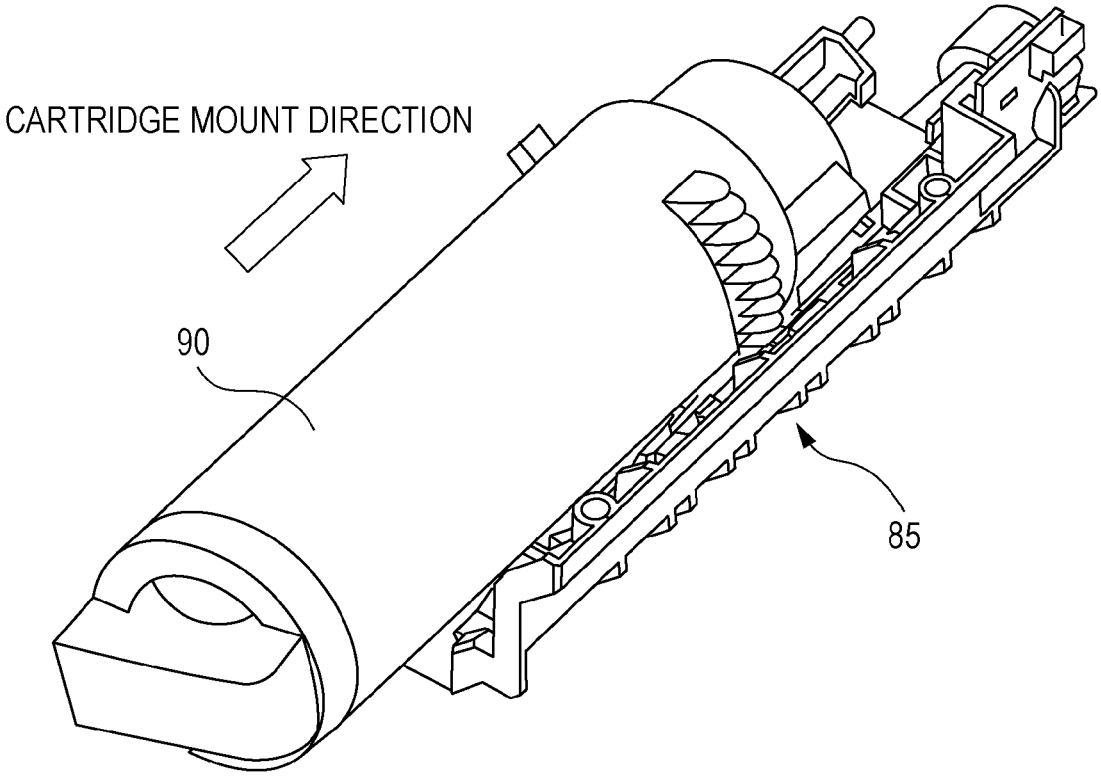
FIGS. 16A and 16B illustrate a state in which the toner cartridge is mounted.
Figure 16B:
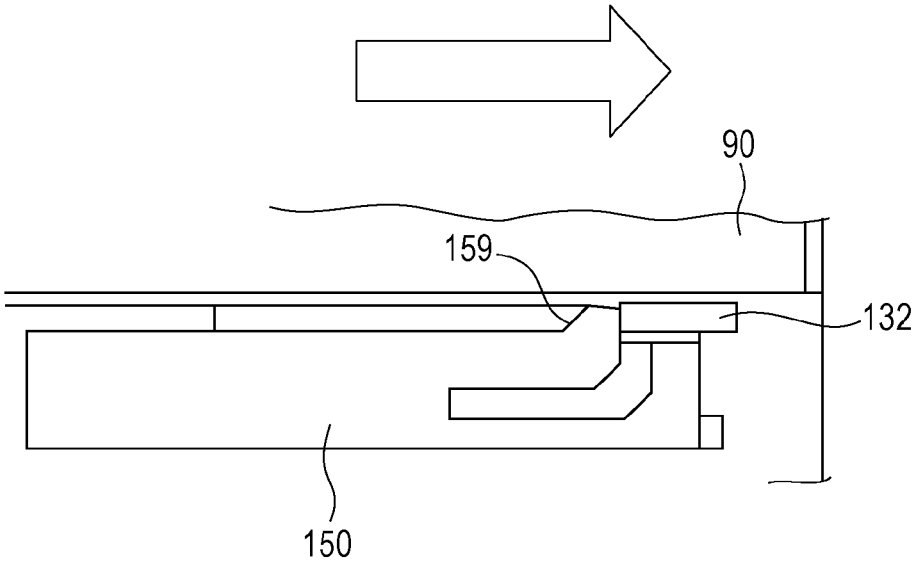

In order to mount the toner cartridge 90 to the cartridge mount portion 85, as illustrated in FIGS. 16A and 16B, the toner cartridge 90 is slid along the cartridge mount portion 85 to be mounted at a prescribed position of the cartridge mount portion 85. In this event, as illustrated in FIG. 13, the guide plates 101 and 102 of the toner cartridge 90 are guided by the guide portions 115 and 116 of the cartridge mount portion 85.

At this time, the shutter member 150 of the toner cartridge 90 is urged upward with the lower surface of the shutter member 150 in contact with the distal end portion 128*b* of the urging member 128 along with movement of the toner cartridge 90. Thus, as illustrated in FIG. 8B, the shutter member 150 is restricted in position with the upper surfaces of the holding portions 153 and 154 of the shutter member 150 in contact with the contact portion 129.

Figure 17A:
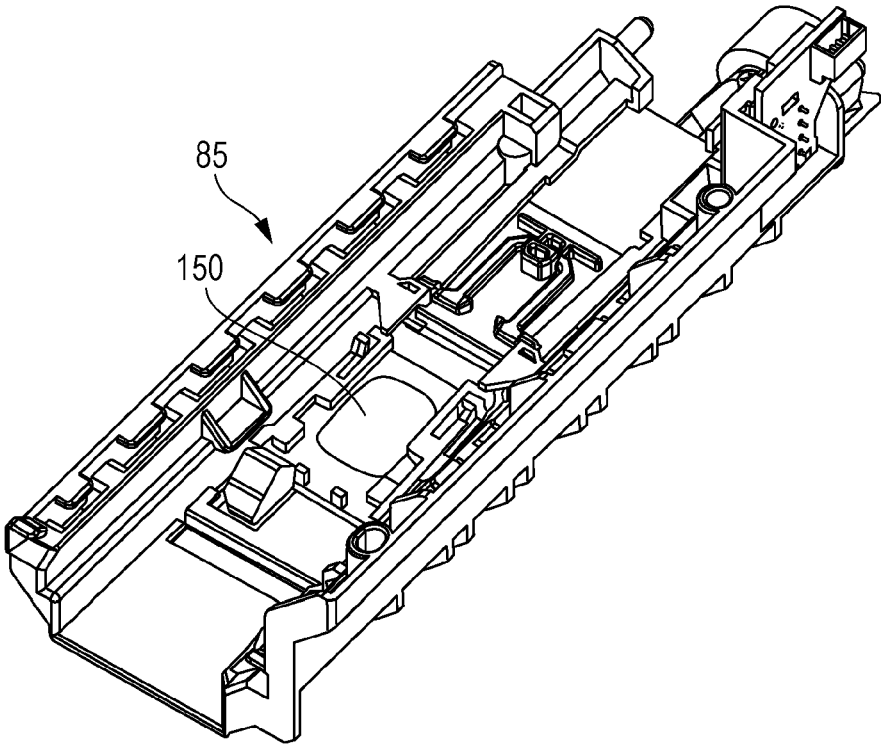
FIGS. 17A and 17B illustrate a mount portion for the toner cartridge.
Figure 17B:
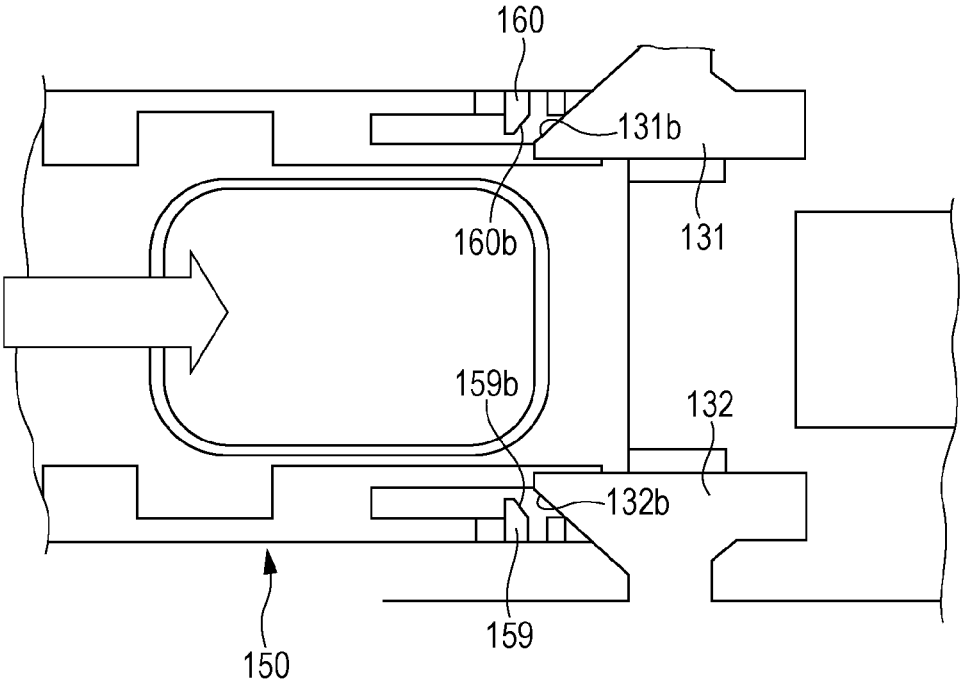

After that, when the toner cartridge 90 is moved toward the distal end of the cartridge mount portion 85 along the mount direction of the toner cartridge 90, the side surfaces 159*b* and 160*b* of the engagement protrusions 159 and 160 of the restricting portions 157 and 158 of the shutter member 150 contact the inclined surfaces 131*b* and 132*b* of the canceling portions 131 and 132 of the cartridge mount portion 85 as illustrated in FIG. 16B, and the restricting portions 157 and 158 of the shutter member 150 are elastically deformed outward along the direction that crosses the mount direction of the toner cartridge 90 as illustrated in FIGS. 8, 17A, and 17B. Consequently, as illustrated in FIG. 9, engagement between the side surfaces 159*a* and 160*a* of the engagement protrusions 159 and 160 of the restricting portions 157 and 158 of the shutter member 150 and the notched portions 96*a* and 97*a* of the mounting/removing portions 96 and 97 of the toner cartridge 90 is released. As a result, the shutter member 150 is stopped in contact with the lower portions of the canceling portions 131 and 132 to achieve an open state in which the toner supply port 92 of the toner cartridge 90 is opened.

In addition, the engagement projected portion 103 provided on the lower end surface of the toner cartridge 90 engages with the engagement recessed portion 123 of the shutter member 118 provided to the cartridge mount portion 85 to push the shutter member 118, which opens the toner receiving port 117 of the cartridge mount portion 85.

After that, a drive force is transmitted from the image forming apparatus body 1*a* side to an agitation/transport member (not illustrated) rotatably provided inside the toner cartridge 90 to rotate the agitation/transport member to supply the toner from the toner supply port 92. The toner supplied from the toner supply port 92 of the toner cartridge 90 is received in the toner receiving port 117 of the cartridge mount portion 85, and transported into the developing device 14 via the first to third toner transport members 87 to 89 of the toner replenishment device 84 and via the joint member 86*a* joined to an end portion of the developing device 14 as illustrated in FIG. 5.

In order to remove the toner cartridge 90 from the cartridge mount portion 85, on the other hand, the toner cartridge 90 is drawn in the direction opposite to the mount direction of the toner cartridge 90. Then, the toner receiving port 117 of the cartridge mount portion 85 is closed by the shutter member 118 with the shutter member 118 pushed in the closing direction by the engagement projected portion 103 of the toner cartridge 90.

In addition, movement of the shutter member 150 of the toner cartridge 90 toward the base end portion along the mount direction is restricted with the shutter member 150 in contact with the engagement surface 128*d* of the urging member 128. In this state, the shutter member 150 is fitted with the mounting/removing portions 96 and 97 of the toner cartridge 90 to close the toner supply port 92 of the toner cartridge 90 with the side surfaces 159*a* and 160*a* of the engagement protrusions 159 and 160 of the restricting portions 157 and 158 of the shutter member 150 and the notched portions 96*a* and 97*a* of the mounting/removing portions 96 and 97 of the toner cartridge 90 in engagement with each other. Then, the toner cartridge 90 is removed from the cartridge mount portion 85 with the toner supply port 92 closed by the shutter member 150.

Figure 18:
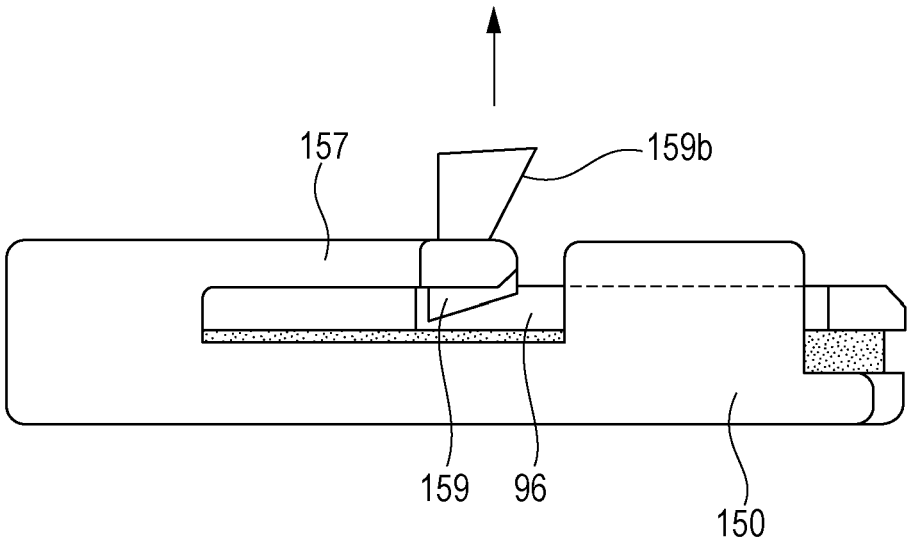
FIG. 18 illustrates the configuration of a portion of a developer storage container according to a modification of the present invention.

In the exemplary embodiment described above, as illustrated in FIG. 8, the restricting portions 157 and 158 of the shutter member 150 are displaced outward in the direction that crosses the opening/closing direction of the shutter member 150 in the direction of projecting from the outer peripheral shape of the shutter member 150 to cancel restriction to the closed position. However, the present invention is not limited thereto. The restricting portions 157 and 158 of the shutter member 150 may be displaced in the direction (direction of the thickness of the shutter member 150) that crosses the upper surface of the shutter member 150 to cancel restriction to the closed position as illustrated in FIG. 18.

In the exemplary embodiment described above, in addition, the shutter member 150 is provided with the restricting portions 157 and 158. However, the toner cartridge 90 may be provided with an elastically deformable restricting portion, and the shutter member 150 may be provided with a retained portion (notched portion) to be retained by the restricting portion.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder storage container comprising:

a storage container body that stores powder therein and that includes a supply portion that supplies the powder;

a movable member that is provided to the storage container body and that is movable between a closed position at which the supply portion is closed and a supply position at which the supply portion is able to supply the powder; and a restricting portion provided on an inner side with respect to an outer peripheral shape of the movable member to restrict movement of the movable member to the supply position, wherein the restricting portion includes engagement protrusions provided at a distal end of the restricting portion, the engagement protrusions projecting inward along a direction that crosses an opening/closing direction of the movable member.

2. The powder storage container according to claim 1, wherein the restricting portion is provided to the movable member, and retained on a retaining portion provided outside the supply portion of the storage container body to restrict movement of the movable member from the closed position at which the supply portion is closed to the supply position.

3. The powder storage container according to claim 2, wherein a mount portion to which the powder storage container is mounted includes a canceling portion that cancels restriction by the restricting portion, and the canceling portion displaces the restricting portion to a position at which retention of the restricting portion on the retaining portion is canceled.

4. The powder storage container according to claim 3, wherein the canceling portion is inserted between the storage container body and the movable member to cancel restriction by the restricting portion.

5. A developer replenishment device comprising:

a developer storage container that stores a developer that is powder therein; and a developer transport member that transports the developer stored in the developer storage container toward a developing device, wherein the powder storage container according to claim 1 is used as the developer storage container.

6. An image forming apparatus comprising:

an image holding element that holds an electrostatic latent image on a surface thereof;

a developing unit that develops the electrostatic latent image held on the surface of the image holding element using a developer; and a developer replenishment unit that replenishes the developing unit with the developer, wherein the developer replenishment device according to claim 5 is used as the developer replenishment unit.

7. A powder storage container comprising:

a storage container body that stores powder therein and that includes a supply portion that supplies the powder;

a movable member that is provided to the storage container body and that is movable between a closed position at which the supply portion is closed and a supply position at which the supply portion is able to supply the powder; and a restricting portion that is deformable toward an outer side with respect to an outer peripheral shape of the movable member to restrict movement of the movable member to the supply position, wherein the restricting portion includes engagement protrusions provided at a distal end of the restricting portion, the engagement protrusions projecting inward along a direction that crosses an opening/closing direction of the movable member.

* * * * *